US008431231B2

(12) United States Patent
Yashiki et al.

(10) Patent No.: US 8,431,231 B2
(45) Date of Patent: Apr. 30, 2013

(54) TITANIUM MATERIAL AND EXHAUST PIPE FOR ENGINE

(75) Inventors: Takashi Yashiki, Osaka (JP); Kenji Yamamoto, Kobe (JP); Eiichiro Yoshikawa, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 1167 days.

(21) Appl. No.: 12/294,619

(22) PCT Filed: Mar. 29, 2007

(86) PCT No.: PCT/JP2007/056799

§ 371 (c)(1), (2), (4) Date: Sep. 26, 2008

(87) PCT Pub. No.: WO2007/114218

PCT Pub. Date: Oct. 11, 2007

(65) Prior Publication Data

US 2010/0173171 A1 Jul. 8, 2010

(30) Foreign Application Priority Data

Mar. 30, 2006 (JP) ..... 2006-095069
Mar. 30, 2006 (JP) ..... 2006-095070
Mar. 30, 2006 (JP) ..... 2006-095071

(51) Int. Cl.

| | |
|---|---|
| ***C22C 14/00*** | (2006.01) |
| ***C22F 1/18*** | (2006.01) |
| ***F01N 13/16*** | (2010.01) |
| ***C23C 24/08*** | (2006.01) |
| ***B32B 15/04*** | (2006.01) |

(52) U.S. Cl.

USPC ..... 428/470; 148/421; 420/418; 420/417

(58) Field of Classification Search ..... 420/417, 420/418, 421; 428/457; 148/421

See application file for complete search history.

(56) References Cited

U.S. PATENT DOCUMENTS 4,398,406 A * 8/1983 Fukuda et al. ..... 72/42
5,125,986 A 6/1992 Kimura et al.

(Continued)

FOREIGN PATENT DOCUMENTS

EP 0 434 069 A1 6/1991
EP 1 464 715 A1 10/2004

(Continued)

OTHER PUBLICATIONS

Donachie, Matthew J.; "Titanium: A Technical Guide"; 2nd Editiion; ASM International; 2000.*

(Continued)

*Primary Examiner* — John J Zimmerman
(74) *Attorney, Agent, or Firm* — Oblon, Spivak, McClelland, Maier & Neustadt, L.L.P.

(57) ABSTRACT

The present invention provides a titanium material having high-temperature oxidation resistance at high temperatures above 800° C. and an exhaust pipe made of this titanium material for an engine. A titanium alloy contains 0.15 to 2% by mass Si, has an Al content below 0.30% by mass, and has equiaxial structure having a mean grain size of 15 μm or above. The high-temperature oxidation resistance of the titanium alloy at high temperatures above 800° C., such as 850° C., is improved by means including adding Nb, Mo and Cr in combination with Si to the titanium alloy, forming equiaxial structure of coarse grains, creating acicular structure, Si-enrichment of a surface layer of the titanium alloy, and reducing impurities including copper, oxygen and carbon contained in the titanium alloy.

11 Claims, 3 Drawing Sheets

U.S. PATENT DOCUMENTS

| | | | | |
|---|---|---|---|---|
| 5,188,677 | A * | 2/1993 | Fukai et al. | 148/501 |
| 5,885,375 | A * | 3/1999 | Takemura et al. | 148/421 |
| 6,309,699 | B2 | 10/2001 | Kawaura et al. | |
| 6,531,091 | B2 | 3/2003 | Miyamoto et al. | |
| 6,984,457 | B2 | 1/2006 | Yamamoto et al. | |
| 7,166,367 | B2 | 1/2007 | Yashiki et al. | |
| 2004/0094241 | A1 * | 5/2004 | Kosaka et al. | 148/421 |
| 2004/0187983 | A1 | 9/2004 | Yashiki | |
| 2004/0265619 | A1 | 12/2004 | Yamamoto et al. | |
| 2005/0202271 | A1 * | 9/2005 | Yashiki et al. | 428/660 |
| 2005/0284544 | A1 * | 12/2005 | Yamamoto et al. | 148/269 |

FOREIGN PATENT DOCUMENTS

| | | | |
|---|---|---|---|
| JP | 3 193850 | | 8/1991 |
| JP | 4-105659 | * | 4/1992 |
| JP | 6 88208 | | 3/1994 |
| JP | 9 256138 | | 9/1997 |
| JP | 10 88258 | | 4/1998 |
| JP | 10 99976 | | 4/1998 |
| JP | 11 36029 | | 2/1999 |
| JP | 11-36029 | A | 2/1999 |
| JP | 2000 034581 | | 2/2000 |
| JP | 3151713 | | 1/2001 |
| JP | 2001 89821 | | 4/2001 |
| JP | 2001-89821 | A | 4/2001 |
| JP | 2001 89883 | | 4/2001 |
| JP | 2001-89883 | A | 4/2001 |
| JP | 2001 234266 | | 8/2001 |
| JP | 2002 3968 | | 1/2002 |
| JP | 2002-3968 | A | 1/2002 |
| JP | 2004 300569 | | 10/2004 |
| JP | 2005 36311 | | 2/2005 |
| JP | 2005 290448 | | 10/2005 |
| JP | 2005 290548 | | 10/2005 |
| JP | 2006 9115 | | 1/2006 |
| RU | 2 272 853 | C1 | 6/2004 |

OTHER PUBLICATIONS

German Office Action issued on Jun. 7, 2011 in corresponding German Application No. 11 2007 000 544.0 filed on Mar. 29, 2007.

* cited by examiner

TITANIUM MATERIAL AND EXHAUST PIPE FOR ENGINE

TECHNICAL FIELD

The present invention relates to a titanium alloy, pure titanium and a surface-treated titanium alloy, which are excellent in high-temperature oxidation resistance, and pure titanium and an exhaust pipe needed to have high-temperature oxidation resistance for an engine. The terms titanium alloy and pure titanium used by the present invention signify titanium alloy materials of different shapes, such as plates, rods, wires and pipes produced by plastic work, such as a rolling process, and a forming process, and pure titanium. Titanium alloy materials and pure titanium will be called inclusively titanium materials. The term "surface-treated titanium material" used by the present invention signifies a titanium materials processed by a shot blasting process using aluminum oxide particles.

BACKGROUND ART

Titanium alloys and pure titanium, as compared with steels, have comparatively high strength, and are progressively applied to the field of transportation machines including automobiles for which lightening is strongly desired as principal machines. Stainless steels are principal materials for forming an exhaust pipe included in an engine exhaust system. Studies have been made to use titanium exhaust pipes for lightening. Since some parts of an exhaust pipe are heated at a high temperature of 500° C. or above, the exhaust pipe is oxidized rapidly and hence high-temperature oxidation resistance is required to improve durability.

Exhaust pipes included in an engine exhaust system are muffler components including an exhaust manifold, an exhaust pipe, a catalytic muffler, a premuffler, a silencer (main muffler) for an automobile or a motorcycle.

Improvements in titanium alloys has been proposed in addition to various surface treatment processes to improve the high-temperature oxidation resistance (hereinafter, referred to also simply as "oxidation resistance") of titanium materials. For example, a titanium alloy proposed in Patent document 1 has an Al content between 0.5 and 2.3% by mass and an $\alpha$ phase as principal structure. A titanium alloy proposed in patent document 2 contains Al and Si in an Al content between 0.3 and 1.5% by mass and a Si content between 0.1 and 1.0% by mass. It is mentioned in Patent document 1 that Si suppresses the growth of crystal grains to improve a fatigue characteristic, limits the reduction of corrosion resistance due to the addition of Al to the lowest possible extent, and improves high-temperature oxidation resistance, scale loss resistance and oxygen diffusion phase formation resistance.

Various surface treatment processes for enhancing the oxidation resistance of titanium materials have been proposed. For example, a material proposed in Patent document 3 is formed by cladding a titanium alloy with an Al plate. A plating method proposed in Patent document 4 coats the surface of a titanium alloy with an Al—Ti material by evaporation. A method proposed in Patent document 5 coats the surface of a titanium alloy with a TiCrAlN film by a PVD process.

The cladding method is costly. An evaporation process and a PVD process need a high processing cost and have difficulty in forming an oxidation-resistant film on the inside surface of a tubular titanium workpiece, such as an exhaust pipe.

Patent document 6 proposes a method of forming an oxygen barrier film capable of preventing the diffusion of oxygen into a material, namely, an oxidation-resistant film, by depositing an inorganic binder and Al powder on the inside surface of a material and subjects the material to firing or a processing method that seals pores formed in the Al powder with a sealing material containing chromic acid as a base material after firing. A previously proposed surface-treated titanium material is formed by an inexpensive, safe surface treatment process developed by incorporating improvements into the foregoing method. For example, Patent document 7 proposes a surface-treated titanium material formed by coating a base material of pure titanium or a titanium-base alloy with a fired oxidation resistant layer of a thickness of 5 μm or above and filling up gaps between Al alloy particles and having a Si atomic percent of 10 at. % or below or pure Al with a compound containing one or some metal elements M including Ti, Zr, Cr, Si and Al, C and/or O.

Patent document 8 proposes a method of improving high-temperature oxidation resistance. This method coats the surface of a titanium alloy with an Al-containing layer by hot dipping and seals gaps in the Al-containing layer and non-plated parts by a blasting process using a high-pressure blast of air containing hard particles of alumina, glass or a metal. Patent document 9 proposes forming a protective film processes the surface of an Al-containing titanium alloy material by a shot blasting process using fine particles of molybdenum, niobium, silicon, tantalum, tungsten and chromium to form a protective film in which the particles are dispersed.

Patent document 1: JP 2001-234266 A (Claims)
Patent document 2: JP 2005-290548 A (Claims)
Patent document 3: JP H10-99976 A (Claims)
Patent document 4: JP H6-88208 A (Claims)
Patent document 5: JP H9-256138 A (Claims)
Patent document 6: JP No. 3151713 B (Claims)
Patent document 7: JP 2006-9115 A (Claims)
Patent document 8: JP 2005-36311 A (Specification)
Patent document 9: JP 2005-34581 A (specification)

DISCLOSURE OF THE INVENTION

Problem to be Solved by the Invention

It is possible that a material forming an exhaust pipe included in an exhaust system for an engine undergoes high-temperature oxidation at a high temperature of, for example, 800° C. Therefore, a titanium material as a material for forming an exhaust pipe of an exhaust system for an engine is required to be excellent in high-temperature oxidation resistance at high temperatures. Some type of a car requires a titanium material that can exercise excellent high-temperature oxidation resistance even at a high temperature above 800° C., such as a temperature in the range of 850° C. to 870° C. As operating temperature rises in a temperature range beyond 800° C., the high-temperature oxidation resistance deteriorates progressively. Therefore even if the titanium material is excellent in high-temperature oxidation resistance at 800° C., the same is not necessarily excellent in high-temperature oxidation resistance at 850° C. In other words, high-temperature oxidation resistance at a high temperature on the order of 850° C. cannot be guaranteed by the evaluation of high-temperature oxidation resistance at 800° C.

As mentioned above, it is known that addition of Al to a titanium material is effective in enhancing the high-temperature oxidation resistance of the titanium material. As mentioned in Patent document 2, addition of Al is inevitably accompanied by the deterioration of corrosion resistance. Patent document 2 adds Si in addition to Al to suppress the deterioration of corrosion resistance due to the addition of Al.

However, as mentioned in patent document 2, guarantee is limited to high-temperature oxidation resistance at high temperatures on the order of 800° C. and cannot cover high-temperature oxidation resistance at high temperatures on the order of 850° C.

Improvement of high-temperature oxidation resistance (hereinafter, referred to also simply as "oxidation resistance") by the composition of the titanium alloy mentioned in Patent documents 1 and 2 cannot be applied to pure titanium because such an improvement deteriorates the formability of pure titanium.

Accordingly, any concrete measures for improving the high-temperature oxidation resistance of an exhaust pipe of pure titanium have not been proposed.

Temperatures at which the high-temperature oxidation resistance of the surface-treated titanium materials mentioned in Patent documents 7 and 8 is effective are on the order of 800° C. The excellent high-temperature oxidation resistance of the surface-treated titanium material of Patent document 9 obtained by processing the surface of the Al-containing titanium alloy material by shot blasting using fine particles is proved by an oxidation test at a high temperature of 950° C.

The metal particles of molybdenum, niobium, silicon, tantalum, tungsten and chromium, alloy particles and oxide particles are expensive, most of those particles are not hard enough for shot blasting. Therefore, it is difficult to form the protective film at a low cost, stably and efficiently. Since those particles are special particles and are hard to obtain. These problems make shot blasting inefficient and expensive. Therefore, those particles are not used in the industrial field for shot blasting.

The present invention has been made under such circumstances and it is therefore an object of the present invention to provide a titanium alloy material, pure titanium material and a surface-treated titanium material having improved high-temperature oxidation resistance at high temperatures beyond 800° C., and to provide efficiently exhaust pipes for engines made by processing the titanium alloy material, pure titanium material and the surface-treated titanium material at a low cost.

Means for Solving the Problem

A first aspect of the present invention to solve the problem is a titanium alloy and an exhaust pipe for an engine.

A titanium alloy excellent in high-temperature oxidation resistance according to the present invention contains 0.15 and 2% by mass Si and has an Al content below 0.30% by mass, wherein the equiaxial structure of the titanium alloy has a mean grain size of 15 μm or above.

A titanium alloy excellent in high-temperature oxidation resistance according to the present invention has a Si content between 0.15 and 2% by mass and an Al content below 0.30% by mass, wherein the titanium alloy has acicular structure.

If the Al content is not limited to a value below 0.30% by mass, a titanium alloy of equiaxial structure having a mean grain size of 15 μm or above and excellent in high-temperature oxidation resistance according to the present invention contains 0.15 to 2% by mass Si, wherein the sum of an Al content and the Si content is 2% by mass or below.

If the Al content is not limited to a value below 0.30% by mass, a titanium alloy having acicular structure and excellent in high-temperature oxidation resistance according to the present invention contains 0.15 to 2% by mass Si, wherein the sum of an Al content and the Si content is 2% by mass or below.

To improve the high-temperature oxidation resistance still further, it is preferable that the titanium alloy further contains at least one element among Nb, Mo and Cr as an additive, and the sum of the Si content and the additive content or the sum of the Si the Al and the additive content is 2% by mass or below.

To improve the high-temperature oxidation resistance still further, it is preferable that the surface of the titanium alloy has a mean Si content of 0.5 at. % or above.

To improve the high-temperature oxidation resistance still further, it is preferable that the titanium alloy has a surface coated with an organometallic compound film having a mean thickness between 10 and 100 μm in a dry state and having an Al content between 30 and 90% by mass in a dry state.

Preferably, a titanium alloy conforming to the foregoing gist or in a preferred embodiment, which will be described later, is used for forming an exhaust pipe for an engine (applied to forming an engine exhaust pipe).

An exhaust pipe excellent in high-temperature oxidation resistance according to the present invention for an engine is made of a titanium alloy conforming to the foregoing gist or in a preferred embodiment, which will be described later.

A second aspect of the present invention to achieve the foregoing object is pure titanium and an engine exhaust pipe.

Pure titanium excellent in high-temperature oxidation resistance according to the present invention has acicular structure formed by heating the pure titanium at the β transformation point or above and cooling the heated pure titanium.

Preferably, the pure titanium is coated with an organometallic compound film having a mean thickness between 10 and 100 μm in a dry state and having an Al content between 30 and 90% by mass in a dry state.

A pure titanium conforming to the foregoing gist or in a preferred embodiment, which will be described later, is used for forming an exhaust pipe for an engine (applied to forming an engine exhaust pipe).

An exhaust pipe excellent in high-temperature oxidation resistance for an engine, according to the present invention is made of pure titanium conforming to the foregoing gist.

A third aspect of the present invention to achieve the object is pure titanium and an exhaust pipe for an engine.

A surface-treated titanium material excellent in high-temperature oxidation resistance to achieve the foregoing object is pure titanium or a titanium alloy having a shot-blasted surface layer processed by shot blasting using aluminum oxide particles, wherein the shot-blasted surface layer has a mean aluminum content of 4 at. % or above.

Preferably, the titanium alloy has a Si content between 0.15 and 2% by mass. Therefore, it is preferable that the titanium alloy has equiaxial structure having a mean grain size of 15 μm or above.

Preferably, a titanium alloy in another embodiment has acicular structure to enhance the high-temperature oxidation resistance of the titanium alloy as a base material.

Preferably, pure titanium has acicular structure to enhance the high-temperature oxidation resistance of a titanium alloy as a base material.

An exhaust pipe excellent in high-temperature oxidation resistance for an engine, according to the present invention is made of the titanium material processed by a surface treatment process.

A fourth aspect of the present invention to achieve the foregoing object is a surface-treated titanium material manufacturing method.

A surface-treated titanium material manufacturing method according to the present invention includes the step of processing the surface of pure titanium or a titanium alloy by shot blasting using aluminum oxide particles, wherein an aggregate of the aluminum oxide particles contains 80% by mass aluminum oxide.

Another surface-treated titanium material manufacturing method according to the present invention includes the step of processing the surface of pure titanium or a titanium alloy by shot blasting using aluminum oxide particles, wherein each of the aluminum oxide particles used for shot blasting contains 80% by mass or above aluminum oxide.

Effect of the Invention

Effect of the First Aspect of the Invention

The present invention is based on an idea different from a conventional idea. The present invention is based on a knowledge that the high-temperature oxidation resistance of a titanium material at high temperatures higher than 800° C., such as those on the order of 850° C., is improved when Al, which is considered to be effective in enhancing the high-temperature oxidation resistance of a titanium material, is not added to the titanium material and only Si is added to the titanium material.

As mentioned above, the high-temperature oxidation resistance of the titanium alloy of the present invention at high temperatures higher than 800° C., such as those on the order of 850° C., can be improved by adding Si in a specific Si content and positively controlling Al.

Effect of the Second Aspect of the Invention

The present invention improves the high-temperature oxidation resistance of pure titanium by forming pure titanium in acicular structure instead of in equiaxial structure.

Effect of the Third and the Fourth Aspect of the Invention

Various surface treatment processes using materials of an Al group for the enhancement of the high-temperature oxidation resistance of titanium materials are known measures proposed in Patent documents 1 to 5. Various surface treatment processes using materials of an Al group are effective in ensuring high-temperature oxidation resistance at temperatures on the order of 800° C., but are unable to ensure high-temperature oxidation resistance practically effective at 850° C. higher than 800° C.

It is inferred that the various conventional surface treatment processes using materials of an Al group, as compared with the surface treatment process according to the present invention, are incapable of satisfactorily uniting a treated layer and the base and of effectively enhancing high-temperature oxidation resistance effective at high temperatures on the order of 850° C. higher than 800° C.

According to the present invention, aluminum oxide particles used for shot blasting pierce into a titanium material to form a surface-treated layer of a titanium matrix and aluminum oxide particles. This surface-treated layer ensures improved high-temperature oxidation resistance at high temperatures on the order of 850° C. higher than 800° C.

BEST MODE FOR CARRYING OUT THE INVENTION

First Embodiment

Figure 1:
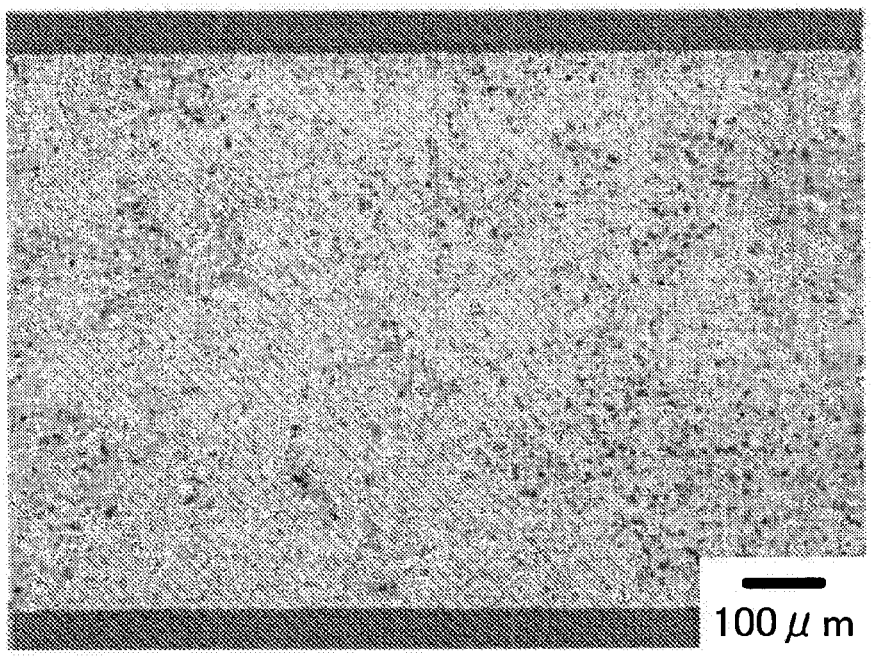
FIG. 1 is a photograph of the fine equiaxial structure of a titanium alloy according to the present invention.

A first embodiment and reasons for limitative conditions will be concretely described.

A titanium alloy in a first embodiment according to the present invention contains 0.15 to 2% by mass Si and below 0.30% by mass Al. The mean grain size of equiaxial structure of the titanium alloy is 15 μm or above.

(Composition of Titanium Alloy)

To provide the titanium alloy of the present invention with excellent high-temperature oxidation resistance at high temperatures, higher than 800° C., (hereinafter, referred to also simply as "high-temperature oxidation resistance"), the titanium alloy contains 0.15 to 2% by mass Si, below 0.30% by mass Al, and titanium and unavoidable impurities as other elements.

(Si)

Silicon (Si) is an essential element for the improvement of high-temperature oxidation resistance. Silicon (Si) enhances strength at high temperatures. Therefore, it is necessary for the titanium alloy to contain Si in 0.15% by mass or above. When the Si content is above 2% by mass, formability is deteriorated remarkably and forming work for forming an exhaust pipe of the titanium alloy is difficult.

(Al)

Aluminum (Al), similarly to Si, Nb, Mo and Cr, is an element that improves high-temperature oxidation resistance. When an operating temperature at which the titanium alloy is used exceeds 800° C., oxide scales are liable to come off, diffusion of oxygen into the base cannot be suppressed when oxide scales come off and, consequently, oxidation resistance is deteriorated. Therefore, the present invention positively limits the Al content to a value below 0.30% by mass which does not cause the foregoing problems. If the Al content is not below 0.3% by mass, oxide scales come off necessarily causing the deterioration of high-temperature oxidation resistance, and high-temperature oxidation resistance at high temperatures on the order of 850° C. higher than 800° C. cannot be achieved.

To prevent the remarkable deterioration of the high-temperature oxidation resistance of the titanium alloy caused by Al, the Al content needs to be limited positively to a value below 0.30% by mass, because the titanium alloy has ordinary, equiaxial structure of fine equiaxed grains having a mean grain size below 15 μm.

When the titanium alloy has equiaxial structure of comparatively coarse crystal grains having a mean grain size of 15 μm or above or acicular structure, the Al content does not need to be below 0.3% by mass. Improvement of high-temperature oxidation resistance by forming the titanium alloy in equiaxial structure of comparatively coarse equiaxed grains or in acicular structure suppresses the deterioration of high-temperature oxidation resistance caused by Al. Therefore, when the titanium alloy has equiaxial structure of comparatively coarse grains or acicular structure, the sum of the Al and the Si content may be 2% by mass or below.

(Nb, Mo and Cr)

Niobium (Nb), Mo and Cr are effective in ensuring high-temperature oxidation resistance effective at high temperatures on the order of 850° C. higher than 800° C. Synergistic effect of Nb, Mo and Cr contained in addition to Si (Nb, Mo and Cr coexisting with Si) and Si can be expected. The titanium alloy of the present invention may contain one or two or more of Nb, Mo and Cr such that the sum of the Si content and the sum of the Nb, the Mo and the Cr content, or the sum of the Si, the Al and the sum of the Nb, the Mo and the Cr content is 2% by mass or below. When the sum of the Si content and the sum of the Nb, the Mo and the Cr content, or the sum of the Si, the Al and the sum of the Nb, the Mo and the Cr content when the titanium alloy contains Al substantially (0.30% by mass Al or above) is above 2% by mass, formability deteriorates and a forming work for forming an exhaust pipe is difficult. Therefore, it is preferable that the sum of the Si content and the sum of the Nb, the Mo and the Cr content, or the sum of the Si, the Al and the sum of the Nb, the Mo and the Cr content is 2% by mass when the titanium alloy contains Al substantially is 2% by mass or below.

(Other Impurities)

The titanium alloy contains oxygen and iron as principal impurities generally in materials to be melted and a melting process. Oxygen and iron deteriorate the formability of the titanium alloy in forming the titanium alloy in the shape of an exhaust pipe. Therefore, it is preferable that the sum of the oxygen and the iron content is 0.20% by mass or below when the titanium alloy contains oxygen and iron.

Copper (Cu) deteriorates high-temperature oxidation resistance. However, Cu is effective in enhancing the high-temperature strength of an exhaust pipe. The titanium alloy may contain Cu so that the sum of the Cu and the Si content, the sum of the Cu, the Si and the Al content or the sum of the Cu, the Si, the Al, the Nb, the Mo and the Co content of the titanium alloy is 2% by mass or below. When the deterioration of formability is taken into consideration, it is preferable that the Cu content is 0.5% by mass or below, more desirably, 0.3% by mass or below.

(Structure of Titanium Alloy)

The titanium alloy of the present invention is formed in a structure conforming to the following preferable conditions in addition to forming the titanium alloy in the foregoing composition to provide the titanium alloy with excellent high-temperature oxidation resistance at high temperatures on the order of 850° C. higher than 800° C. The titanium alloy is formed in a structure conforming to one or two or more conditions requiring increasing the mean Si content of a surface layer of the titanium alloy, increasing the mean grain size of the titanium alloy structure, and forming the titanium alloy in acicular structure. Synergistic effect of those conditions can be expected by using those structures in combination with the foregoing composition.

(Augmentation of Si Content of Surface Layer)

When Si is concentrated in a surface layer of the titanium alloy, the higher the mean Si content of the surface layer of the titanium alloy, the more excellent is the titanium alloy in high-temperature oxidation resistance. To make the titanium alloy more excellent in high-temperature oxidation resistance, it is preferable that the titanium alloy of the present invention is formed in a structure such that the mean Si content of the surface layer of the titanium alloy is 0.5 at. % or above. Silicon (Si) dissolved in titanium may be concentrated in the surface layer or Si contained in the surface layer may be an intermetallic compound of Ti and Si, such as $Ti_5Si_3$, or a silicon compound, such as silicon oxide or silicon carbide.

Basically, the Si content of the surface layer rises as the Si content of the titanium alloy (the base) increases. When a titanium alloy having a Si content in the specified range is manufactured by an ordinary process, it is possible that the Si is concentrated in the surface layer in a mean Si content of 0.5 at. % or above. On the other hand, when the titanium alloy is manufactured by some manufacturing method, it is possible that a surface layer of several micrometers in thickness contaminated with oxygen and carbon is formed in some cases. In such a case, the mean Si content of the surface layer is below 0.5 at. % and an excellent high-temperature oxidation resistance improving effect cannot be expected. Thus the Si content of the surface layer of the titanium alloy is not dependent simply on the Si content of the titanium alloy. Therefore, it is preferable to determine manufacturing conditions selectively so that formation of a contaminated surface layer contaminated with oxygen and carbon may be avoided to form a surface layer having a mean Si content of 0.5 at. % or above.

The Si content of the surface layer of the titanium alloy can be measured through the quantitative analysis of the surface by wave dispersive spectroscopy (WDS) included in x-ray electron probe micro analysis (EPMA). More specifically, a test part of the surface layer to be analyzed is magnified at a magnification in the range of 500× to 1000× magnification, elements contained in the test part are determined by qualitative analysis, the respective quantities of the elements are measured by semiquantitative analysis using a ZAF method and the element contents are determined. Although the element contents of the surface layer is dependent on the depth of penetration of an electron beam used for the analysis, the depth of penetration of the electron bean is in the range of about 1 to about 2.5 μm when acceleration voltage for the analysis is fixed at 15 kV. The Si content of the surface layer as mentioned in connection with the present invention is the mean Si content of a surface layer of a thickness in the range of about 1 to about 2.5 μm. In the following description, the Si content of the surface layer is based on this definition.

(Equiaxed Grains)

A titanium alloy manufactured by a conventional method has an ordinary equiaxial structure. The equiaxial structure ensures the characteristics including formability and mechanical characteristics, such as strength, of the titanium alloy.

(Mean Grain Size)

The mean grain size of the titanium alloy dominates the high-temperature oxidation resistance of the titanium alloy having equiaxial structure. A comparatively large mean grain size enhances high-temperature oxidation resistance. More concretely, a high-temperature oxidation resistance enhancing effect becomes apparent when the mean grain size is 15 μm or above, and becomes remarkable when the mean grain size is, preferably 20 μm or above, more desirably, 30 μm or above. When the mean grain size is excessively large, surface roughening occurs during forming and fatigue strength reduces. When the titanium alloy is to be used for uses in which those conditions are important, the upper limit of the mean grain size is on the order of 100 μm.

Although the influence of the grain size on high-temperature oxidation resistance at high temperatures on the order of 850° C. exceeding 800° C. has not been elucidated up to the present, it is conjectured that the grain size is related with a mechanism of the progress of high-temperature oxidation. The diffusion of oxygen through the surface into a material when the material is exposed to high temperatures is likely to occur in grain boundaries. Thus it is conjectured that a material having a larger mean grain size and less grain boundaries can more effectively suppress high-temperature oxidation.

When a Ti—Si titanium alloy of the present invention is manufactured by a conventional method, an intermetallic compound of Ti and Si, such as $Ti_5Si_3$, and β phase are dispersed in a titanium matrix and suppress the growth of crystal grains. The crystal grain growth suppressing effect of Si is mentioned in Patent document 2. Thus it is difficult for an ordinary method to make crystal grains grow in a mean grain size of 15 μm or above effective in suppressing high-temperature oxidation.

More concretely, although a cold rolling process, namely, a conventional process for manufacturing a titanium alloy, uses different percentage rolling reductions for rolling materials of different qualities, an ordinary percentage rolling reduction is in the range of about 20% to about 70%. An annealing temperature of an annealing process following the cold rolling process is in the range of 600° C. to 800° C. An annealing process using a long annealing time in the range of several hours to ten and odd hours, such as a vacuum annealing process, uses a low annealing temperature in the range of about 600° C. and about 700° C. An annealing process using a short annealing time, such as a continuous annealing and pickling process, uses a high annealing temperature in the range of about 700° C. and about 800° C. It is difficult to make crystal grains grow in a mean grain size of 15 μm or above even if the Ti—Si titanium alloy is cold-rolled and annealed at temperatures in the foregoing ordinary temperature range. In other words, A Ti—Si titanium alloy having a mean grain size of 15 μm or below are manufactured under conditions in the range of conditions for the conventional process.

To manufacture a Ti—Si titanium alloy of the present invention having crystal grains having a mean grain size of 15 μm or above, cold rolling process uses a low percentage rolling reduction of 20% or below and a high annealing temperature in the range of 825° C. to the β transformation point. Preferably, the percent rolling reduction is 15% or below, more desirably, 10% or below. A preferable annealing temperature is in the range of 850° C. to the β transformation point. When the annealing temperature is above the β transformation point acicular structure is formed. When it is important for a member to have equiaxed grains, and to be industrially stable and satisfactory in formability and mechanical properties, an upper limit to the annealing temperature is the β transformation point or below.

(Effect of Al Content)

The Al content does not need to be below 0.30% by mass as mentioned above when a titanium alloy has equiaxial grain structure of comparatively coarse grains having a mean grain size of 15 μm or above. Equiaxial structure of comparatively coarse crystal grains suppresses the deterioration of high-temperature oxidation resistance caused by Al in proportion to the improvement of high-temperature oxidation resistance. This effect is higher when the mean grain size of the titanium alloy is greater.

(Method of Measuring Crystal Grain Size)

The term crystal grain size used in the present invention signifies a mean grain size in a section along a rolling direction (L) in which the titanium alloy is rolled. A surface of a section of a specimen (test piece) sampled from a titanium alloy plate is ground roughly in a roughness between 0.05 and 0.1 mm, the ground surface is mirror-finished, and then the surface is etched. The etched surface is observed under an optical microscope at 100× magnification. Sizes of grains in the surface are measured in the foregoing direction by a line intercept method. The length of one measuring line is 0.95 mm. Five fields each of three lines are observed. Thus a total length of measuring line is 0.95×15 mm. A mean grain size of ten mean grain sizes of measured grain sizes of ten optional parts in a middle part of the titanium alloy plate excluding a leading end part and a trailing end part of the plate is employed as the mean grain size of the titanium alloy.

(Acicular Structure)

When uses allow some deterioration of formability and mechanical properties of a titanium alloy having equiaxed grains, the titanium alloy may have acicular structure for the further improvement of the high-temperature oxidation resistance at high temperatures above 800° C.

As mentioned above, the Al content does not need to be below 30% by mass when the titanium alloy has acicular structure. Deterioration of the high-temperature oxidation resistance by Al can be compensated by the improvement of the high-temperature oxidation resistance by the acicular structure. The titanium alloy is formed entirely in acicular structure when the annealing temperature is higher than the β transformation point.

Generally, titanium alloys have equiaxial structure because the titanium alloys are processed by a final annealing process at temperatures not higher than the β transformation point. According to the present invention, the titanium alloy may be formed in acicular structure instead of equiaxed grains to provide the titanium alloy with excellent high-temperature oxidation resistance. There is not any particular restriction on the method of forming the titanium alloy in acicular structure; the titanium alloy is formed in acicular structure, for example, by heating the titanium alloy for final heating at a temperature not lower than the β transformation point after cold rolling and cooling the heated titanium alloy. The titanium alloy of acicular structure can be obtained when the titanium alloy is heated at a temperature not lower than the β transformation point by a final heating process (when the final heating temperature is not lower than the β transformation point) even if the titanium alloy is heated at a low temperature before being heated at a temperature not lower than the β transformation point and cooled after cold rolling. For example, the structure of even coils, sheets and processed members of a titanium alloy of equiaxial structure obtained by heating the titanium alloy at a temperature not higher than the β transformation point after cold rolling can be converted into acicular structure by heating the coils, sheets and processed members again at temperatures not lower than the β transformation point.

Acicular structure, differing from equiaxial structure requiring the control of grain size, can be created necessarily (simply) by heating a titanium alloy at a temperature not lower than the β transformation point and cooling the heated titanium alloy regardless of the percentage rolling reduction of cold rolling (without controlling percentage rolling reduction). In some cases, restrictive conditions on the thickness of products for practical uses do not permit the optional selection and control of the percentage rolling reduction of cold rolling. In such a case, the selection of acicular structure without sticking to equiaxial structure is useful for improving high-temperature oxidation resistance. Cooling after heating may be natural cooling and neither of rapid cooling and force cooling is necessary.

(Microstructure of Section)

Figure 2:
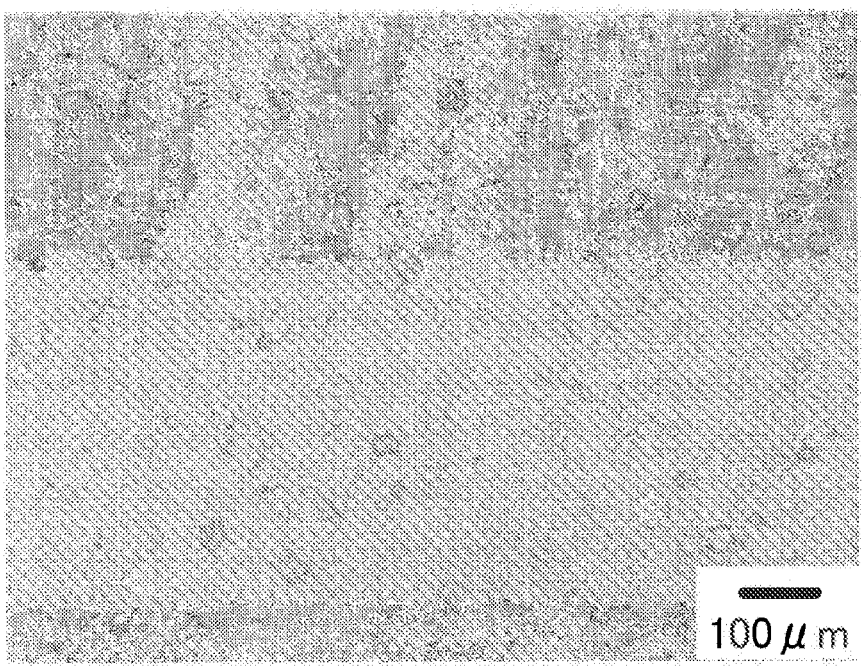
FIG. 2 is a photograph of the coarse equiaxial structure of a titanium alloy according to the present invention.
Figure 3:
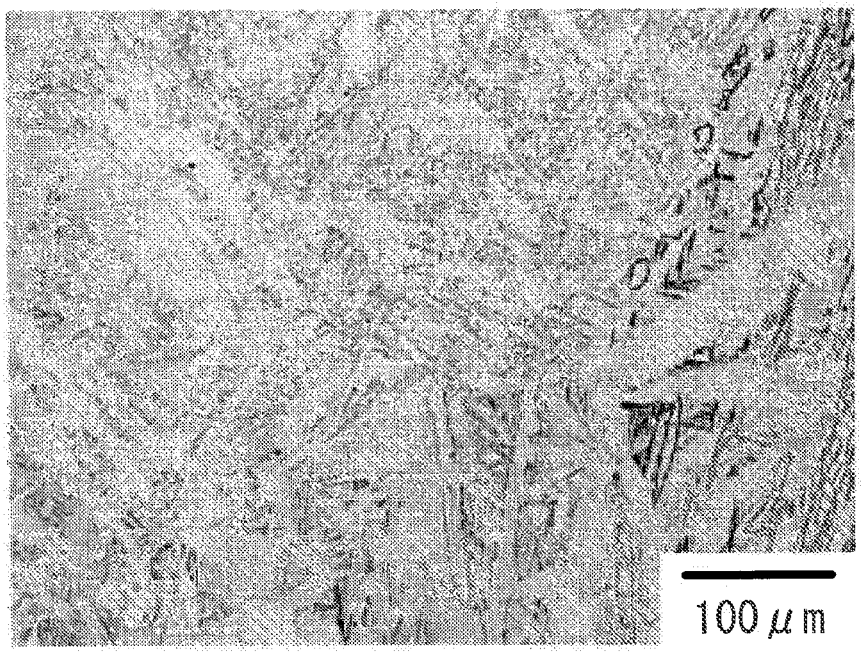
FIG. 3 is a photograph of acicular structure of a titanium alloy according to the present invention.

Photographs shown in FIGS. 1 and 2 show the microstructure of equiaxed grains in sections. A photograph shown in FIG. 3 shows the microstructure of acicular grains in a section. FIGS. 1 and 2 are the microstructure of sections of a titanium alloy observed under an optical microscope at a 100× magnification. FIG. 3 is the microstructure of a section of a titanium alloy observed under an optical microscope at a 200× magnification.

The section of a titanium alloy shown in FIG. 1 has equiaxial structure and the mean grain size of grains in equiaxial structure is 15 μm or below. The section of a titanium alloy shown in FIG. 2, similarly to the section shown in FIG. 1, has equiaxial structure. However the mean grain size of grains in equiaxial structure is on the order of 30 μm because the titanium alloy was rolled at a low percentage rolling reduction and was heated by high-temperature annealing. A titanium alloy having the section shown in FIG. 3 was heated at a temperature not lower than the β transformation point and was cooled after heating and has acicular structure.

The titanium alloy shown in FIG. 1 was made by processing a titanium alloy having a composition expressed by Ti-0.5 Si-0.1 Al-0.2 Nb (numerals indicate content in percent by mass) by a cold rolling process at a percentage rolling reduction of 40% and an atmospheric annealing at 800° C. for 6 min. The titanium alloy shown in FIG. 2 was made by processing the same titanium alloy by a cold rolling process at a percentage rolling reduction of 10% and an atmospheric annealing at 850° C. for 6 min. The titanium alloy shown in FIG. 3 was made by processing the same titanium alloy by a cold rolling process at a percentage rolling reduction of 40%, heating by a heating process at 950° C. higher than the β transformation point of about 900° C. for 6 min and a cooling the heated titanium alloy by a cooling process following the heating process.

Whereas the mean grain size of equiaxial structure can be determined, the means grain size of acicular structure shown in FIG. 3 cannot be determined. The present invention has difficulty in specifying acicular structure by ordinary mean grain size and aspect ratio. Acicular structure is specified precisely by a manufacturing process, namely, history. This acicular structure is acicular structure created by a heat treatment process that heats a titanium alloy at a temperature not lower than the β transformation temperature. As mentioned above, the titanium alloy may be processed by a low-temperature heat treatment process before and after the heat treatment process that heats the titanium alloy at a temperature not lower than the β transformation point and cools the heated titanium alloy.

(Manufacturing Method)

Although a method of manufacturing the titanium alloy of the present invention is the foregoing preferred manufacturing method and is subject to conditions for selectively creating desired structure, the titanium alloy can be manufactured by an ordinary manufacturing method including an ingot forming process, a hot forging process, a hot rolling process, an annealing process, a cold rolling process, and an annealing process or a heat treatment process. Preferable structure for improving high-temperature oxidation resistance is selectively created, as mentioned above, by changing conditions for cold rolling, and annealing or heat treatment.

(Surface Treatment)

Since the titanium alloy thus manufactured is excellent in oxidation resistance at high-temperatures on the order of about 850° C. may be used without being processed by a surface treatment process. The titanium alloy may be processed by various surface treatment processes before use instead of being used with its bare surface exposed.

Preferably, a coating formed by a surface treatment process is excellent in oxidation resistance at high-temperatures on the order of about 850° C. A coating having such a characteristic formed by a surface treatment process is an organometallic compound film having a mean thickness in the range of 10 to 100 μm in dry state and an Al content in the range of 30 to 90% by mass in a dry state.

The organometallic compound film is a stable, easy-to-handle, low-toxicity organometallic compound film of titanium acetylacetonate, zirconium acetylacetonate, chromium acetate, silicone, silica sol, alumina sol and aluminum isopropoxide containing Al flakes or Al particles.

The surface of the titanium alloy of the present invention is coated with a film of an aqueous or solvent solution or a dispersion of an organometallic compound having a predetermined Al content by a known process, such as a coating process or a dipping process, and the film is dried at a temperature no higher than 200° C. When the film is dried at a temperature not higher than 200° C., higher high-temperature oxidation resistance is expected. If the film is dried at a high temperature not lower than 200° C., the film hardens rapidly, and the Al flakes or Al particles are fixated with many voids formed in the film. The voids permit the penetration of oxygen through the film and it is difficult to provide the titanium alloy with excellent high-temperature oxidation resistance. When the film is dried at a temperature not higher than 200° C., the film hardens gradually allowing the Al flakes or the Al particles to move in the film to fill up voids. Consequently, the film does not have voids and excellent high-temperature oxidation resistance can be provided.

The organometallic compound film has a thickness in the range of 10 to 100 μm in a dry state and an Al content in the range of 30 to 90% by mass in a dry state. If the mean thickness (film thickness) in a dry state is below 10 μm, the titanium base is exposed to a corrosive atmosphere through defects, such as pinholes, the abrasion margin of the film is excessively small and the film cannot exercise a protective function and is useless as a protective film.

If the mean thickness (film thickness) in a dry state is above 100 μm, the film is liable to come off due to stress induced therein. Thus the mean thickness in a dry state is in the range of 10 to 100 μm. The mean thickness is the mean of ten measured thickness data of ten parts of a section of the film determined through observation under an optical microscope.

If the mean Al content of the film in a dry state is below 30% by mass, an effect on further improvement of high-temperature oxidation resistance is unsatisfactory. If the mean Al content of the film in a dry state is above 90% by mass, the strength of the film is insufficient and hence the film breaks at an early stage of use due to external forces and the contraction of the base. Thus the mean Al content of the film in a dry state is in the range of 30 to 90% by mass. The mean Al content of the film is the mean of ten measured Al content data of ten parts in the surface or in a section of the film determined by EPMA.

The highest high-temperature oxidation resistance can be achieved when the film contains Al (added) in flakes. High-temperature oxidation resistance at higher temperatures can be achieved also by using Al particles or a mixture of Al flakes and Al particles. The film improves high-temperature oxidation resistance at high temperatures on the order of 850° C. because the film containing Al is resistant to high temperature oxidation and it is conjectured that Al contained in the film and the titanium contained in the base interact and form a layer resistant to high temperature oxidation when the titanium alloy is exposed to high temperatures.

The present invention will be concretely described in terms of its examples. It is noted that the following examples are not restrictive, proper changes may be made in the examples within the scope of the foregoing and the following gist, and those changes are within the technical scope of the present invention.

Example 1

The high-temperature oxidation resistance at a high temperature of 850° C. of cold-rolled titanium plates respectively having compositions shown in Tables 1 and 2 was evaluated. More specifically, ingots having the compositions shown in tables 1 and 2 and a weight of about 120 g were made by using a button arc furnace. Cleaned scraps of pure titanium of type 1 specified in JIS was used for supplying titanium. Each ingot was processed by conventional hot forging, hot rolling and annealing processes and then, the ingot was processed by a cold rolling process at a predetermined percentage rolling reduction to obtain a cold-rolled plate. The cold-rolled plate was degreased and annealed at predetermined temperature under predetermined conditions to obtain a cold-rolled sheet of 2 mm in thickness. Specimens of 2 mm in thickness, 25 mm in width and 25 mm in length were sampled from the cold rolled sheets.

(Mean Grain Size Control)

The titanium alloys whose specimens had mean grain sizes not greater than 10 μm (indicated by "<10" in Tables 1 and 2) among the titanium alloys shown in Tables 1 and 2 were cold-rolled at a percentage rolling reduction of about 40% which is in a percentage rolling reduction range for conventional cold rolling and were processed by vacuum annealing at 800° C. for 6 min.

The titanium alloys whose specimens had mean grain sizes above 15 μm among the titanium alloys shown in Tables 1 and 2 were cold-rolled at low percentage rolling reductions selected from those in a range not higher than 20% and not in an ordinary range according to desired mean grain sizes and qualities and were processed by vacuum annealing at temperatures selected from those in a range of 825° C. to the β transformation point for 6 min.

(Acicular Structure)

A test material was obtained by subjecting a plate obtained by cold rolling at a percentage rolling reduction of about 40% in an ordinary range to vacuum heating at 950° C. exceeding the β transformation point for 6 min. The structure of a specimen sampled from this test material was entirely acicular.

(Control of Mean Si Content of Surface Layer)

A test material having a Si-enriched surface layer having a mean Si content of 0.5 at. % or above was made. A material was subjected to cold rolling at a percentage rolling reduction of about 40%. The cold-rolled material was subjected to atmospheric annealing at 850° C. for 6 min instead of vacuum annealing. To remove a contaminated surface layer of several micrometers in thickness contaminated with oxygen, carbon and such from the titanium alloy, the titanium alloy was immersed in a molten salt heated at 600° C. and containing 55% by mass $NaNO_3$, 35% by mass NaOH and other substances including KCl and NaCl for 1 min, the titanium alloy was immersed in an aqueous solution heated at 60° C. and containing 1% by mass HF and 20% by mass $HNO_3$ for pickling to remove a layer of 50 μm in thickness from each side of the plate. The pickled plate was immersed in thoroughly stirred, flowing water for 2 min for cleaning immediately after pickling, and then the plate was immersed in stirred hot water heated at 80° C. for 3 min for hot-water cleaning to obtain a test material.

A pickling process was carried out under the foregoing conditions after annealing to remove a surface layer of 100 μm in thickness (50 μm from each side) to remove completely contaminated surface layers (enriched layers) contaminated with oxygen, carbon and such due to the interaction of the surfaces with rolling mill oil during cold rolling. The test material was cleaned by sufficient running-water immersion and hot-water cleaning to prevent the reduction of the Si content of the surface by the deposition of a thick oxide film and an impurity film of impurities contained in the pickling solution due to unsatisfactory cleaning after pickling. It is conjectured that the foregoing processes augment the Si content of the surface layer relatively.

The mean grain size of specimens of test materials produced under the foregoing manufacturing conditions was 10 μm or below. A specimen having a mean grain size greater than 15 μm was made by cold rolling using a percentage rolling reduction of 20% or below. A still lower percentage rolling reduction was used to obtain a specimen having a still greater mean grain size. The Si-enrichment of a surface layer of a specimen having acicular structure was achieved by carrying out the atmospheric annealing at 950° C. higher than the β transformation point for 6 min and the foregoing processes for the Si enrichment of the surface layer under the foregoing conditions.

Each specimen was analyzed by the following method to determine the Si content of the surface layer. The specimen was subjected to ultrasonic cleaning in acetone for several minutes to remove contaminants including oil adhering to the surface before analysis. The specimen was analyzed by an EPMA analyzer (JXA-8900RL, Nippon Denshi-sha). A magnification of 500× and an acceleration voltage of 15 kV were used for analysis. Elements present in the surface were identified by qualitative analysis, and the respective amounts of the elements present in the surface were determined by semi-quantitative analysis using a ZAF method.

(High-Temperature Oxidation Resistance)

High-temperature oxidation resistance was evaluated by a high-temperature oxidation test. The weight of each of the specimens was measured before and after exposing the specimen to the high-temperature atmosphere of 850° C. higher than 800° C. for 100 h. A weight increment caused by the high-temperature oxidation test, namely, an oxidation weight increment ($mg/cm^2$), of the specimen was determined. It was decided that the specimens having a smaller oxidation weight increment were more excellent in high-temperature oxidation resistance. The weight of oxide scales came off the specimen was added to the measured weight. Measured data is shown in Tables 1 and 2.

As obvious from Tables 1 and 2, specimens 1 to 11 of the examples of the present invention meeting requisite conditions for composition required by the present invention and specimens 12 to 26 and 27 to 35 meeting requisite conditions for structure or requisite conditions for Si surface enrichment required by the present invention were excellent in high-temperature oxidation resistance at 850° C.

(Effect of Composition)

The specimens 1 to 11 of the present invention had equiaxial structure of fine grains of a mean grain size smaller than 10 μm and compositions meeting the required conditions. The specimen 3 of the present invention containing only Si and having a Si content near a lower limit Si content of 0.15% by mass was inferior to the specimens 4 and 5 having a higher Si content in high-temperature oxidation resistance at 850° C., which proved the high-temperature oxidation resistance improving effect of Si. The specimen 5 had a Si content near the upper limit Si content of 2% by mass and a Vickers hardness of Hv 230 higher than those of other specimens by Hv 50 to Hv 80. It was expected that the titanium alloy in the specimen 5 was difficult to be formed in an exhaust pipe.

The specimen 2 having a comparatively high Al content was inferior to the specimen 1 having the same Si content and a comparatively low Al content in high-temperature oxidation resistance at 850° C. because oxide scales of the specimen 2 were liable to come off. The significance of limiting the Al content to a value below 0.30% by mass to improve high-temperature oxidation resistance was verified from the foregoing data and data on specimens of comparative examples having an excessively high Al content, which will be described later.

Specimens 6 to 11 contain Nb, Mo and Cr in combination with Si and are relatively excellent in high-temperature oxidation resistance at 850° C. as compared with the specimen 1 containing only Si and having the same Si content, which verifies effect of Nb, Mo and Cr on improving the high-temperature oxidation resistance of the titanium alloy.

(Effect of Grain Size and Si Content of Surface Layer)

Specimens 12 to 26 of examples of the present invention had equiaxial structure and had different mean grain sizes and surface layers differing from each other in mean Si content. It was found through the comparative examination of the specimens 12 to 14, the specimens 15 and 16, the specimens 17 and 18, and the specimens 22 and 24 that the specimens having greater mean grain sizes of 15 μm or above had higher high-temperature oxidation resistance at 850° C., which proved the high-temperature oxidation resistance improving effect of coarse crystal grains.

Although the specimens 15 to 18 of the examples having coarse crystal grains had a high Al content of 0.30% by mass or above, the specimens 15 to 18 had excellent high-temperature oxidation resistance at 850° C. through somewhat lower than that of the specimens 12 to 14 of the examples having coarse crystal grains and an Al content of 0.30% by mass or below, which proved the effect of coarse crystal grains on suppressing the adverse effect of Al content to improve high-temperature oxidation resistance.

Even though the specimens 25 and 26 of the examples had an Al content above 0.30% by mass had excellent high-temperature oxidation resistance at 850° C. though somewhat lower than that of the specimens 23 and 24 of the examples having an Al content of 0.30% by mass and a Si-enriched surface layer, which proved the effect of suppressing the adverse effect of containing Al caused by the Si-enrichment of the surface layer on the improvement of high-temperature oxidation resistance at higher temperatures.

(Effect of Acicular Structure)

Specimens 27 to 35 of examples of the present invention shown in Table 2 have acicular structure and differ from each other in composition and mean Si content of the surface layer.

Even though the specimens 28, 30 and 31 had an Al content above 0.30% by mass, the specimens 28, 30 and 31 had excellent high-temperature oxidation resistance at 850° C. though somewhat lower than that of the specimens 27 and 29 having an Al content of 0.30% by mass or below, which proved the effect of acicular structure on suppressing the adverse effect of containing Al to improve high-temperature oxidation resistance at higher temperatures.

The specimen 35 of the example having a surface layer having an increased Si content, as compared with the specimen 27 of the example not having an increased Si content, is excellent in high-temperature oxidation resistance at 850° C., which proved the combined effect of acicular structure and the Si-enrichment of the surface layer on improving high-temperature oxidation resistance at higher temperatures.

Specimens 32 and 33 of the examples of the present invention containing Nb, Mo and Cr in combination with Si were relatively excellent in high-temperature oxidation resistance at 850° C. as compared with the specimen 29 of the example containing only Si and having the same Si content, which proved the combined effect of acicular structure and the inclusion of Nb, Mo and Cr on the improvement of the titanium alloy at higher temperatures.

Comparative Examples

Specimens 36 to 40 shown in Table 2 were those of comparative examples. The specimens 36 to 40 were markedly inferior to the specimens of the examples of the present invention in high-temperature oxidation resistance at 850° C.

Even though the specimens 36 to 40 of the comparative examples had an Al content of 0.30% by mass or below, the same had an excessively low Si content. The specimens 37 to 40, in particular, had markedly low high-temperature oxidation resistance at 850° C. even though means for adding Nb, Mo and Cr and forming acicular structure of coarse crystal gains were applied to forming the specimens 36 to 40. Thus it was proved the high effect of Si on improving high-temperature oxidation resistance at 850° C. as compared with those of the foregoing means.

Specimens 41 and 42 of the comparative examples had an excessively high Si content and a Vickers hardness in the range of Hv 280 to Hv 300, which were higher than the Vickers hardness of the specimen 5 of the example having the upper limit Si content by Hv 50 to Hv 70. Therefore, it was expected to be impossible to form exhaust pipes by forming the specimens 41 and 42. Thus the significance of the upper limit Si content was verified.

Specimens 43 and 44 of the comparative examples had equiaxial structure of fine crystal grains having a mean grain size below 10 μm, had surface layers not Si-enriched and had an excessively high Al content higher than the upper limit Al content. Consequently, the specimens 43 and 44 had remarkably low high-temperature oxidation resistance at 850° C. Thus the significance of limiting the Al content to values below 0.30% by mass in improving high-temperature oxidation resistance at 850° C. was proved from the properties of the specimens 43 and 44 and the specimens of the examples of the present invention having a high Al content.

Specimens 45 and 46 of the comparative examples contained oxygen and iron excessively in an oxygen content and an iron content exceeding predetermined upper limits for impurities. Therefore, the specimens 45 and 46 had very low formability. It was expected to be impossible to form exhaust pipes by forming the specimens 45 and 46.

Specimens 36 to 46 of the comparative examples were tested by a high-temperature oxidation resistance test at a comparatively low temperature of 800° C., which had been the conventional criteria for high-temperature oxidation resistance evaluation. An oxidation weight increment of each of the specimens caused by the high-temperature oxidation test reduced by a value in the range of about 2 to about 15 mg/cm$^2$.

TABLE 1

| | Specimen | Titanium alloy | | | | | | | |
|---|---|---|---|---|---|---|---|---|---|
| | | Composition (% by mass) | | | Structure | | Surface layer | | |
| Category | No. | Basic structure | Selected elements | Impurities | Structure | Mean grain size (μm) | Mean Si content (at. %) | Oxidation increment B (mg/cm$^2$) | Remarks |
| Examples | 1 | Ti—0.5Si—0.05Al | | 0.1(Fe + O) | Equiaxed | <10 | 0.4 | 17.9 | |
| | 2 | Ti—0.5Si—0.10Al | | 0.1(Fe + O) | Equiaxed | <10 | 0.4 | 18.9 | |
| | 3 | Ti—0.2Si—0.05Al | | 0.1(Fe + O) | Equiaxed | <10 | 0.4 | 19.8 | Si: Lower limit |
| | 4 | Ti—1.0Si—0.05Al | | 0.1(Fe + O) | Equiaxed | <10 | 0.9 | 16.2 | |
| | 5 | Ti—2Si—0.05Al | | 0.1(Fe + O) | Equiaxed | <10 | 1.5 | 15.4 | Si: Upper limit |

TABLE 1-continued

| Category | Specimen No. | Titanium alloy: Composition (% by mass): Basic structure | Selected elements | Impurities | Structure: Structure | Mean grain size (μm) | Surface layer: Mean Si content (at. %) | Oxidation increment B (mg/cm$^2$) | Remarks |
|---|---|---|---|---|---|---|---|---|---|
| | 6 | Ti—0.5Si—0.05Al— | 0.2N | 0.1(Fe + O) | Equiaxed | <10 | 0.4 | 16.9 | |
| | 7 | Ti—0.5Si—0.05Al— | 0.2Nb—0.2Mo | 0.1(Fe + O) | Equiaxed | <10 | 0.4 | 15.8 | |
| | 8 | Ti—0.5Si—0.05Al— | 0.2Nb—0.2Mo—0.2Cr | 0.1(Fe + O) | Equiaxed | <10 | 0.4 | 15.1 | |
| | 9 | Ti—0.5Si—0.05Al— | 0.2Mo—0.2Cr | 0.1(Fe + O) | Equiaxed | <10 | 0.4 | 16.9 | |
| | 10 | Ti—0.5Si—0.05Al | 0.2Mo | 0.1(Fe + O) | Equiaxed | <10 | 0.4 | 17.0 | |
| | 11 | Ti—0.5Si—0.05Al | 0.2Cr | 0.2(Fe + O) | Equiaxed | <10 | 0.4 | 17.3 | Much Fe and $O_2$ |
| Examples | 12 | Ti—0.5Si—0.05Al | | 0.1(Fe + O) | Equiaxed | 18 | 0.4 | 12.0 | Coarse crystal grains |
| | 13 | Ti—0.5Si—0.05Al | | 0.1(Fe + O) | Equiaxed | 50 | 0.4 | 11.2 | Coarse crystal grains |
| | 14 | Ti—0.5Si—0.05Al | | 0.1(Fe + O) | Equiaxed | 70 | 0.4 | 10.4 | Coarse crystal grains |
| | 15 | Ti—0.5Si—0.3Al | | 0.1(Fe + O) | Equiaxed | 20 | 0.4 | 14.7 | Much Al |
| | 16 | Ti—0.5Si—0.3Al | | 0.1(Fe + O) | Equiaxed | 55 | 0.4 | 14.0 | Much Al |
| | 17 | Ti—0.5Si—0.4Al | | 0.1(Fe + O) | Equiaxed | 82 | 0.4 | 13.3 | Much Al |
| | 18 | Ti—0.5Si—0.4Al | | 0.1(Fe + O) | Equiaxed | 79 | 0.4 | 12.8 | Much Al |
| | 19 | Ti—0.45Si—0.5Al | 0.2Nb | 0.1(Fe + O) | Equiaxed | 30 | 0.4 | 11.0 | Much Al |
| | 20 | Ti—0.7Si—0.05Al | | 0.1(Fe + O) | Equiaxed | <10 | 0.7 | 9.1 | Si concentration |
| | 21 | Ti—1.0Si—0.05Al | | 0.1(Fe + O) | Equiaxed | <10 | 1.5 | 8.3 | Si concentration |
| | 22 | Ti—1.5Si—0.05Al | | 0.1(Fe + O) | Equiaxed | <10 | 2.2 | 7.2 | Si concentration |
| | 23 | Ti—1.5Si—0.05Al | | 0.1(Fe + O) | Equiaxed | 54 | 2.1 | 6.0 | Si concentration |
| | 24 | Ti—1.5Si—0.05Al | | 0.1(Fe + O) | Equiaxed | 75 | 2.1 | 5.3 | Si concentration |
| | 25 | Ti—1.5Si—0.4Al | | 0.1(Fe + O) | Equiaxed | <10 | 2.2 | 9.5 | Much Al |
| | 26 | Ti—1.5Si—0.4Al | | 0.1(Fe + O) | Equiaxed | <10 | 2.0 | 9.7 | Much Al |

TABLE 2

| Category | Specimen No. | Titanium alloy: Composition (% by mass): Basic structure | Selected elements | Impurities | Structure: Structure | Mean grain size (μm) | Surface layer: Mean Si content (at. %) | Oxidation increment B (mg/cm$^2$) | Remarks |
|---|---|---|---|---|---|---|---|---|---|
| Examples | 27 | Ti—0.5Si—0.1 Al | | 0.1(Fe + O) | Acicular | — | 0.4 | 10.7 | |
| | 28 | Ti—0.45Si—0.5Al | 0.2Nb | 0.1(Fe + O) | Acicular | — | 0.4 | 11.4 | Much Al |
| | 29 | Ti—1.0Si—0.05Al | | 0.1(Fe + O) | Acicular | — | 0.4 | 9.5 | |
| | 30 | Ti—1.0Si—0.4Al | | 0.1(Fe + O) | Acicular | — | 0.4 | 12.7 | Much Al |
| | 31 | Ti—1.0Si—0.6Al | | 0.1(Fe + O) | Acicular | — | 0.6 | 12.8 | Much Al |
| | 32 | Ti—1.0Si—0.05Al | 0.2Nb—0.2Mo | 0.1(Fe + O) | Acicular | — | 0.4 | 7.9 | |
| | 33 | Ti—1.0Si—0.05Al | 0.2Mo—0.2Cr | 0.1(Fe + O) | Acicular | — | 0.4 | 8.5 | |
| | 34 | Ti—0.5Si—0.1Al | | 0.1(Fe + O) | Acicular | — | 0.6 | 7.4 | Si concentration |
| | 35 | Ti—1.0Si—0.1Al | | 0.1(Fe + O) | Acicular | — | 1.6 | 6.2 | Si concentration |
| Comparative examples | 36 | Ti—0.1Si—0.05Al | | 0.1(Fe + O) | Equiaxed | <10 | 0.4 | 33.5 | Excessively low Si content |
| | 37 | Ti—0.1Si—0.05Al | | 0.1(Fe + O) | Equiaxed | 58 | 0.4 | 29.2 | Excessively low Si content |
| | 38 | Ti—0.1Si—0.05Al | 0.2Nb—0.2Mo—0.2Cr | 0.1(Fe + O) | Equiaxed | 57 | 0.4 | 25.3 | Excessively low Si content |
| | 39 | Ti—0.1Si—0.05Al | | 0.1(Fe + O) | Acicular | — | 0.4 | 28.9 | Excessively low Si content |
| | 40 | Ti—0.1Si—0.05Al | 0.2Nb—0.2Mo—0.2Cr | 0.1(Fe + O) | Acicular | — | 0.4 | 24.8 | Excessively low Si content |
| | 41 | Ti—2.5Si—0.05Al | | 0.1(Fe + O) | Equiaxed | <10 | 0.4 | 4.5 | Excessively high Si content |
| | 42 | Ti—2.5Si—0.05Al | | 0.1(Fe + O) | Acicular | — | 0.4 | 3.7 | Excessively high Si content |
| | 43 | Ti—0.5Si—0.4Al | | 0.1(Fe + O) | Equiaxed | <10 | 0.4 | 21.9 | Excessively high Al content |
| | 44 | Ti—0.5Si—0.6Al | 0.2Nb—0.2Mo—0.2Cr | 0.1(Fe + O) | Equiaxed | <10 | 0.4 | 20.9 | Excessively high Al content |
| | 45 | Ti—0.1Si—0.05Al | 0.2Nb—0.2Mo—0.2Cr | 0.25(Fe + O) | Equiaxed | <10 | 0.4 | 28.3 | Excessive Fe + O |
| | 46 | Ti—1.5Si—0.05Al | 0.2Nb—0.2Mo—0.2Cr | 0.3(Fe + O) | Equiaxed | <10 | 0.4 | 28.7 | Excessive Fe + O |

(Surface-Treated Titanium Alloy)

Some titanium alloys of the present invention chosen from the titanium alloys shown in Tables 1 and 2 were coated with Al-containing organometallic compound films, respectively, and the high-temperature oxidation resistance of those films was tested. Test results are shown in Table 3.

More concretely, specimens of the titanium alloys of the present invention each coated with the film were subjected to a high-temperature oxidation resistance test under the same conditions as those mentioned above, and an oxidation weight increment A of each of the specimens was measured. The ratio of the oxidation weight increment A to an oxidation increment B in the high-temperature oxidation resistance test of the titanium alloy shown in table 1 or 2 corresponding to the titanium alloy of the present invention (without film coating), namely, oxidation weight increment ratio A/B, was calculated to evaluate the high-temperature oxidation resistance of the film. It was considered that the effect of the film on enhancing high-temperature oxidation resistance was high and the film had high high-temperature oxidation resistance when the oxidation weight increment ratio A/B was low. In Table 3, a circle indicates a specimen having an oxidation weight increment ratio A/B of 0.4 or below, a triangle indicates a specimen having an oxidation weight increment ration A/B in the range of above 0.45 to 0.65, and a cross indicates a specimen having an oxidation weight increment ration A/B in the range above 0.65.

The specimen of the foregoing example was coated with a film having a thickness in a dry state and an Al content in a dry state shown in Table 3. The specimen was coated with the film by immersing the specimen in a solution prepared by mixing a not modified silicone resin containing aluminum flakes and an organic solvent. The coated specimen was dried either of (1) a drying process including a preparatory drying process that heats the specimen at 120° C. for 15 min and a finish drying process that heats the specimen at 190° C. for 30 min (drying temperature: 190° C. in Table 3) and (2) a drying process including a preparatory drying process that heats the specimen at 120° C. for 15 min and a finish drying process that heats the specimen at 210° C. for 30 min (drying temperature: 210° C. in Table 3).

As obvious from Table 3, the organometallic compound films of the specimens 48 and 55 to 57 each having a mean thickness in a dry state in the foregoing preferable range of 10 to 100 μm and an Al content in a dry state in the range of 30 to 90% by mass were excellent in high-temperature oxidation resistance. The oxidation weight increments of the specimens respectively coated with the satisfactory films determined by the high-temperature oxidation resistance test were smaller than those of the corresponding titanium alloys shown in Tables 1 and 2, respectively, and the difference between each of the former oxidation weight increments and each of the corresponding latter oxidation weight increments was comparatively large, which proved the excellent high-temperature oxidation resistance of the films.

The specimens 47 and 49 each coated with a film having a mean thickness equal to the upper or the lower limit of the preferable range, the specimens 50 and 51 each coated with a film having an Al content in a dry state equal to the upper or the lower limit of the preferable range, and the specimen 52 dried at an excessively high drying temperature outside the preferable range were satisfactory in high-temperature oxidation resistance as compared with the specimens 53 and 54 each coated with a film outside those preferable ranges and were inferior in high-temperature oxidation resistance to the specimens 48 and 55 to 57 coated with the films having film conditions within the foregoing preferable ranges.

Thus the critical significance of the foregoing preferable film condition ranges and the foregoing preferable drying condition ranges for the high-temperature oxidation resistance of the films is known.

TABLE 3

| | Surface-treated titanium alloy | | | | | | | | |
|---|---|---|---|---|---|---|---|---|---|
| | Base titanum alloy | | | Coating | | | | | Grade of high-temperature |
| Specimen No. | Basic composition | Structure | Titanium alloys shown in Tables 1 and 2 | Thickness (μm) | Al Content (% by mass) | Drying temperature (° C.) | Oxidation increment A (mg/cm$^2$) | Ratio A/B (B: Tables 1 and 2) | oxidation resistance of coating |
| 47 | Ti—0.5Si—0.10Al | Equiaxed | Specimen No. 2 in Table 1 | 11 | 59 | 190 | 11.3 | 0.60 | Δ |
| 48 | Ti—0.5Si—0.10Al | Equiaxed | Specimen No. 2 in Table 1 | 61 | 61 | 190 | 7.9 | 0.42 | ○ |
| 49 | Ti—0.5Si—0.10Al | Equiaxed | Specimen No. 2 in Table 1 | 102 | 60 | 190 | 11.7 | 0.62 | Δ |
| 50 | Ti—0.5Si—0.10Al | Equiaxed | Specimen No. 2 in Table 1 | 63 | 31 | 190 | 11.2 | 0.59 | Δ |
| 51 | Ti—0.5Si—0.10Al | Equiaxed | Specimen No. 2 in Table 1 | 61 | 88 | 190 | 9.5 | 0.50 | Δ |
| 52 | Ti—0.5Si—0.10Al | Equiaxed | Specimen No. 2 in Table 1 | 60 | 62 | 210 | 13.6 | 0.72 | x |
| 53 | Ti—0.5Si—0.10Al | Equiaxed | Specimen No. 2 in Table 1 | 7 | 64 | 190 | 17.8 | 0.94 | x |
| 54 | Ti—0.5Si—0.10Al | Equiaxed | Specimen No. 2 in Table 1 | 62 | 25 | 190 | 16.8 | 0.89 | x |
| 55 | Ti—0.5Si—0.05Al | Coarse equiaxed | Specimen No. 14 in Table 1 | 45 | 46 | 190 | 3.8 | 0.37 | ○ |
| 56 | Ti—1.0Si—0.05Al | Acicular | Specimen No. 27 in Table 2 | 58 | 73 | 190 | 3.1 | 0.29 | ○ |
| 57 | Ti—1.0Si—0.1 Al | Concentrated acicular Si | Specimen No. 33 in Table 2 | 79 | 81 | 190 | 2.7 | 0.32 | ○ |

* Coating having lower ratios A/B have higher high-temperature oxidation resistance Second Embodiment A second embodiment and reasons for limitative conditions will be concretely described. Pure titanium in a second embodiment according to the present invention has acicular structure created by heating pure titanium at a temperature not lower than the β transformation point.

(Pure Titanium)

Pure titanium may be ordinary kinds of pure titanium of type 4 to type 1 specified in JIS and having a titanium purity of 99.5% by mass or above. Incidentally, the pure titanium of type 1 specified in JIS has a purity of 99.8% by mass or above, and the pure titanium of type 2 specified in JIS has a purity of 99.7% by mass or above.

(Structure of Pure Titanium)

Commercial pure titanium manufactured by a conventional method is processed by a final annealing process at a temperature of the β transformation point or below after cold rolling and has equiaxial structure. The pure titanium of the present invention is formed in acicular structure instead of equiaxial structure to provide the pure titanium with excellent high-temperature oxidation resistance. There are not any particular restrictions on the method of creating acicular structure. For example, acicular structure can be created by heating cold-rolled pure titanium at a temperature of β transformation point or above and cooling the heated pure titanium. Acicular structure can be created by reheating a workpiece, such as a coil, a sheet or a member, of pure titanium of equiaxed structure annealed at a temperature of the β transformation point or below after cold rolling at a temperature of the β transformation point or above and cooling the heated workpiece. Thus acicular structure can be created when a final heating temperature is the β transformation point or above. The heated pure titanium may be cooled by any one of air cooling, water cooling and furnace cooling.

(Microstructure of Section)

Figure 4:
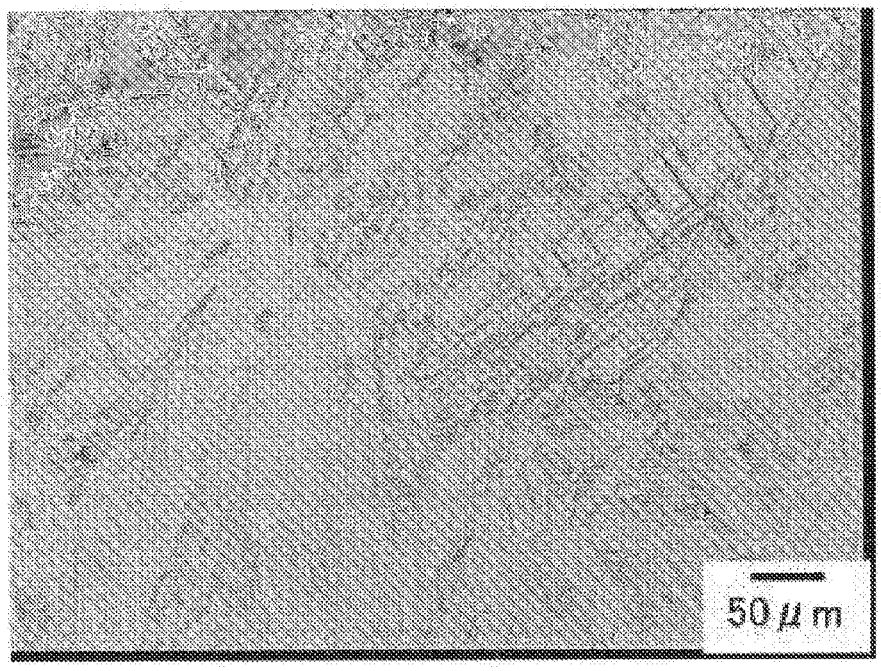
FIG. 4 is a photograph of acicular structure of pure titanium according to the present invention.
Figure 5:
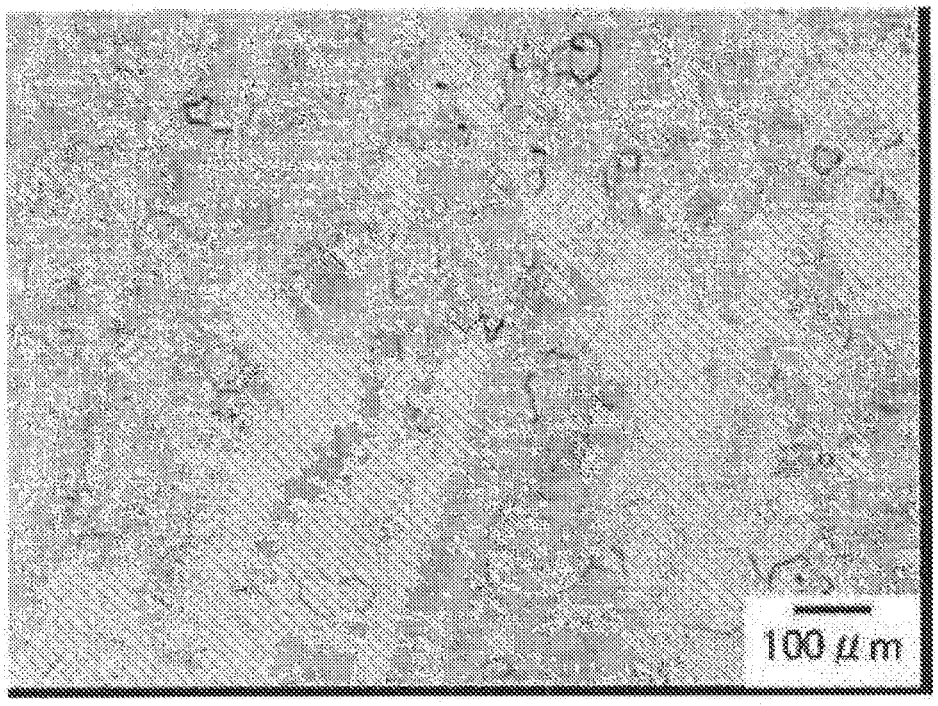
FIG. 5 is a photograph of equiaxial structure of conventional pure titanium.

FIG. 4 is a photograph showing the microstructure of a section of pure titanium of type 2 having acicular structure. FIG. 5 is a photograph showing the microstructure of a section of pure titanium of type 2 having equiaxial structure as a comparative example.

The pure titanium shown in FIG. 4 is an example 2 of the present invention shown in Table 4 made by cold-rolling pure titanium of type 2 at a percentage rolling reduction of 40%, heating the cold-rolled pure titanium at 950° C. higher than the β transformation point for 6 min in the atmosphere, and cooling the heated pure titanium by natural cooling.

The pure titanium shown in FIG. 4 is a comparative example 5 shown in Table 4 made by cold-rolling pure titanium of type 2 at a percentage rolling reduction of 40%, and heating the cold-rolled pure titanium at 800° C. for 6 min for atmospheric annealing.

The mean grain size of acicular structure shown in FIG. 4 cannot be determined like that of equiaxed structure is determined. Therefore it is difficult to define acicular structure by ordinary means, such as mean grain size and aspect ratio. Acicular structure of the present invention can be precisely defined by manufacturing method, namely, the history of the acicular structure. The acicular structure is created by a heating process that heats pure titanium at a temperature of the β transformation point or above.

(Selective Creation of Structure)

As mentioned above, selective creation of acicular structure or equiaxial structure is dependent on the heating temperature of the final annealing process. Acicular structure can be necessarily created in the entire surface of a titanium material when cold-rolled pure titanium is heated at a temperature of the β transformation point or above and the heated pure titanium is cooled regardless of the percentage rolling reduction of cold rolling. Equiaxed structure can be necessarily created when cold-rolled pure titanium alloy is heated at a temperature of the β transformation point or below. Acicular structure can be created even if the pure titanium is not heated at a temperature of the β transformation point or above and heated at a low temperature in a period between cold rolling and cooling, provided that the pure titanium is heated at a temperature of the β transformation point or above at a final stage, i.e., when the final heating temperature is the β transformation point or above. Ordinary commercial pure titanium having equiaxial structure may be processed to obtain pure titanium having acicular structure (used for the present invention).

(Manufacturing Method)

Pure titanium is manufactured by a conventional method (commercial pure titanium manufacturing method, including ingot casting, hot forging, hot rolling, annealing, cold rolling and, when necessary, annealing or heat treatment, excluding heating the pure titanium at a temperature of the β transformation point or above after cold rolling, and cooling the heated pure titanium.

(Surface Treatment)

The pure titanium of the present invention thus manufactured is excellent in high-temperature oxidation resistance on the order of about 800° C. and hence can be used without being processed by a surface treatment. The pure titanium processed by various surface treatments may be used instead of being used with its bare surface exposed.

It is preferable that a film formed by a surface treatment is excellent in high-temperature oxidation resistance on the order of about 800° C. Preferably a film formed by a surface treatment and having such a property is an organometallic compound film having a mean thickness in the range of 10 to 100 μm in a dry state and an Al content in the range of 30 to 90% by mass in a dry state.

The organometallic compound film is a stable, easy-to-handle, low-toxicity organometallic compound film of titanium acetylacetonate, zirconium acetylacetonate, chromium acetate, silicone, silica sol, alumina sol and aluminum isopropoxide containing Al flakes or Al particles.

Preferably, the pure titanium of the present invention is coated with a coating solution, i.e., an aqueous or solvent solution or dispersion of the organometallic compound containing a predetermined amount of Al by a known method, such as a coating method or a dipping method, and the film coating the pure titanium is dried at 200° C. or below. It is expected that heating the film at 200° C. or below provides a film having still higher high-temperature oxidation resistance.

Although dependent on the type of the film, the film hardens rapidly and the Al flakes or Al particles are fixated with many voids formed in the film if the film formed on the pure titanium is dried at a temperature above 200° C. The voids permit the penetration of oxygen through the film and it is difficult to provide the pure titanium with excellent high-temperature oxidation resistance. When the film is dried at 200° C. or below, the drying process takes a long time, Al flakes and Al powder move, fill up gaps and harden. Consequently, gaps in the film are reduced and the film has excellent high-temperature oxidation resistance.

The thus dried organometallic compound film has a mean thickness in the range of 10 to 100 μm and a mean Al content in the range of 30 to 90% by mass. If the mean thickness (film thickness) in a dry state is below 10 μm, the titanium base is exposed to a corrosive atmosphere through defects, such as pinholes, the abrasion margin of the film is excessively small and the film cannot exercise a protective function and is useless as a protective film.

If the mean thickness (film thickness) in a dry state is above 100 μm, the film is liable to come off due to stress induced therein. Thus the mean thickness in a dry state is in the range of 10 to 100 μm. The mean thickness is the mean of ten measured thickness data of ten parts of a section of the film determined through observation under an optical microscope.

If the mean Al content of the film in a dry state is below 30% by mass, an effect on further improvement of high-temperature oxidation resistance is unsatisfactory. If the mean Al content of the film in a dry state is above 90% by mass, the strength of the film is insufficient and hence the film breaks at an early stage of use due to external forces and the contraction of the base. Thus the mean Al content of the film in a dry state is in the range of 30 to 90% by mass. The mean Al content of the film is the mean of ten measured Al content data of ten parts in the surface or in a section of the film determined by EPMA.

The highest high-temperature oxidation resistance can be achieved when the film contains Al (added) in flakes. High-temperature oxidation resistance at higher temperatures can be achieved also by using Al particles or a mixture of Al flakes and Al particles. The film (coating) improves high-temperature oxidation resistance at high temperatures because the film containing Al is resistant to high temperature oxidation and it is conjectured that Al contained in the film and the titanium contained in the base interact and form a layer resistant to high temperature oxidation when the pure titanium is exposed to high temperatures.

cooled by natural cooling, and the cooled pure titanium plate was descaled by a conventional method using molten salt and nitric hydrofluoric acid. Specimens sampled from the thus processed cold-rolled plates had acicular structure.

Specimens of comparative examples were sampled from the foregoing commercial pure titanium plates.

(High-Temperature Oxidation Resistance)

High-temperature oxidation resistance was evaluated by a high-temperature oxidation test. An oxidation weight increment ($mg/cm^2$) of each specimen caused by the high-temperature oxidation test was determined from the weight of the specimen measured before and after exposing the specimen to the high-temperature atmosphere of 800° C. for 100 h. It was decided that the specimens having a smaller oxidation weight increment were more excellent in high-temperature oxidation resistance. Measured results are shown in Table 4.

As obvious from Table 4, specimens 1 to 4 of the examples of the present invention made by processing the pure titanium of types 1 to 4 had acicular structure and were excellent and very excellent in high-temperature oxidation resistance.

The specimens 5 to 8 of the comparative examples sampled from the pure titanium of types 1 to 4 had equiaxed structure and were remarkably inferior to the specimens 1 to 4 in high-temperature oxidation resistance.

The pure titanium of types 1 to 4 of acicular structure and the pure titanium of types 1 to 4 of equiaxed structure are conspicuously different from each other in high-temperature oxidation resistance. It was proved that acicular structure had high effect on improving high-temperature oxidation resistance.

TABLE 4

| | | Pure titanium | | | | |
|---|---|---|---|---|---|---|
| Specimen No. | Category | Composition specified in JIS | Temperature of heating after cold rolling | Structure | Mean grain size (μm) | Oxidation increment B ($mg/cm^2$) |
| 1 | Examples | Class 1 | β transformation point or above | Acicular | — | 9.9 |
| 2 | | Class 2 | β transformation point or above | Acicular | — | 10.2 |
| 3 | | Class 3 | β transformation point or above | Acicular | — | 12.7 |
| 4 | | Class 4 | β transformation point or above | Acicular | — | 13.9 |
| 5 | Comparative | Class 1 | Below β transformation point | Equiaxed | 30 | 22.7 |
| 6 | examples | Class 2 | Below β transformation point | Equiaxed | 22 | 24.5 |
| 7 | | Class 3 | Below β transformation point | Equiaxed | 16 | 26.2 |
| 8 | | Class 4 | Below β transformation point | Equiaxed | 11 | 26.9 |

The present invention will be more concretely described in terms of its examples. It is noted that the following examples are not restrictive, proper changes may be made in the examples within a scope conforming to the foregoing and the following gist, and those changes are within the technical scope of the present invention.

Example 2

The high-temperature oxidation resistance of cold-rolled plates of pure titanium respectively having compositions specified in JIS and shown in Tables 4 was evaluated. Specimens of 2 mm in thickness, 25 mm in width and 25 mm in length were sampled from pure titanium plates of types 1, 2, 3 and 4 specified in JIS. the high-temperature oxidation resistance of the specimens was evaluated after changing the structure of the specimens.

Each of the cold rolled pure titanium plates was heated at 950° C. higher than the β transformation point for 6 min by atmospheric heating, the heated pure titanium plate was (Surface-Treated Pure Titanium)

Some pure titanium of the present invention chosen from the pure titanium shown in Table 4 were coated with Al-containing organometallic compound films, respectively, and the high-temperature oxidation resistance of those films were tested. Test results are shown in Table 5.

More concretely, specimens of the pure titanium of the present invention each coated with the film were subjected to a high-temperature oxidation resistance test under the same conditions as those mentioned above, and an oxidation weight increment A of each of the specimens was measured. The ratio of the oxidation weight increment A to an oxidation increment B in the high-temperature oxidation resistance test of the pure titanium corresponding to the pure titanium of the present invention (without film coating) shown in table 4, namely, oxidation weight increment ratio A/B, was calculated to evaluate the high-temperature oxidation resistance of the film. It was considered that the effect of the film on enhancing high-temperature oxidation resistance was high and the film had high high-temperature oxidation resistance when the oxidation weight increment ratio A/B was low. In Table 5, a circle indicates a specimen having an oxidation weight increment ratio A/B of 0.5 or below, a triangle indicates a specimen having an oxidation weight increment ration A/B in the range of above 0.5 to 0.7, and a cross indicates a specimen having an oxidation weight increment ration A/B in the range above 0.7.

The specimen of the foregoing example was coated with a film having a thickness in a dry state and an Al content in a dry state shown in Table 5. The specimen was coated with the film by immersing the specimen in a solution prepared by mixing a not modified silicone resin containing aluminum flakes and an organic solvent. The coated specimen was dried either of (1) a drying process including a preparatory drying process that heats the specimen at 120° C. for 15 min and a finish drying process that heats the specimen at 190° C. for 30 min (drying temperature: 120° C. in Table 5) and (2) a drying process including a preparatory drying process that heats the specimen at 120° C. for 15 min and a finish drying process that heats the specimen at 210° C. for 30 min (drying temperature: 210° C. in Table 3).

As obvious from Table 5, the organometallic compound films of the specimens 10 and 17 to 19 each having a mean thickness in a dry state in the foregoing preferable range of 10 to 100 μm and an Al content in a dry state in the range of 30 to 90% by mass were excellent in high-temperature oxidation resistance. The oxidation weight increments of the specimens respectively coated with the satisfactory films determined by the high-temperature oxidation resistance test were smaller than those of the corresponding pure titanium shown in Tables 4, respectively, which proved the excellent high-temperature oxidation resistance of the films.

The specimens 9 and 11 each coated with a film having a mean thickness equal to the upper or the lower limit of the preferable range, the specimens 12 and 13 each coated with a film having an Al content in a dry state equal to the upper or the lower limit of the preferable range, or the specimen 14 dried at an excessively high drying temperature outside the preferable range were satisfactory in high-temperature oxidation resistance as compared with the specimens 15 and 16 each coated with a film outside those preferable ranges and were inferior in high-temperature oxidation resistance to the specimens 10 and 17 to 19 coated with the films having film conditions within the foregoing preferable ranges.

Thus the critical significance of the foregoing preferable film condition ranges and the foregoing preferable drying condition ranges for the high-temperature oxidation resistance of the films is known.

TABLE 5

| | Surface-treated pure titanium | | | | | | |
|---|---|---|---|---|---|---|---|
| | Corresponding pure | Coating | | | | Ratio A/B (B: Corresponding | Grade of high- |
| Specimen No. | titanium in Table 4 | Thickness (μm) | Al content (% by mass) | Drying temperature (° C.) | Oxidation increment A (mg/cm$^2$) | pure titanium in Tables 4 and 5) | temperature oxidation resistance of coating |
| 9 | Specimen No. 2 in Table 4 | 11 | 59 | 190 | 7.1 | 0.70 | Δ |
| 10 | Specimen No. 2 in Table 4 | 61 | 61 | 190 | 4.5 | 0.44 | ○ |
| 11 | Specimen No. 2 in Table 4 | 102 | 60 | 190 | 6.2 | 0.61 | Δ |
| 12 | Specimen No. 2 in Table 4 | 63 | 31 | 190 | 5.8 | 0.59 | Δ |
| 13 | Specimen No. 2 in Table 4 | 61 | 88 | 190 | 6.6 | 0.65 | Δ |
| 14 | Specimen No. 2 in Table 4 | 60 | 62 | 210 | 6.8 | 0.67 | Δ |
| 15 | Specimen No. 2 in Table 4 | 7 | 64 | 190 | 9.4 | 0.92 | x |
| 16 | Specimen No. 2 in Table 4 | 62 | 25 | 190 | 8.9 | 0.87 | x |
| 17 | Specimen No. 2 in Table 4 | 45 | 46 | 190 | 4.8 | 0.47 | ○ |
| 18 | Specimen No. 2 in Table 4 | 58 | 73 | 190 | 4.9 | 0.48 | ○ |
| 19 | Specimen No. 2 in Table 4 | 79 | 81 | 190 | 4.9 | 0.48 | ○ |

* Coating having lower ratios A/B have higher high-temperature oxidation resistance

Third Embodiment

A third embodiment and reasons for limitative conditions will be concretely described. Each of surface-treated titanium materials of pure titanium or a titanium alloy in the third embodiment has a shot-blasted surface layer processed by shot blasting using aluminum oxide particles. The shot-blasted surface layer has a mean aluminum content of 4 at. % or above.

(Shot-Blasted Surface Layer Formed by Shot Blasting Using Aluminum Oxide Particles)

The present invention processes the titanium material by a shot blasting process using aluminum oxide particles to improve the high-temperature oxidation resistance of the titanium material at high temperatures higher than 800° C. (simply high-temperature oxidation resistance, below). The shot blasting process sprays a high-speed stream of aluminum oxide particles on the surface of the titanium material. The aluminum oxide particles are implanted in the surface of the titanium material of pure titanium or a titanium alloy to form a surface layer integrally containing aluminum oxide, as a principal component, and the titanium base As mentioned above, the surface layer integrally containing aluminum oxide, as a principal component, and the titanium base improves high-temperature oxidation resistance at high temperatures higher than 800° C., such as 850° C.

(Mean Aluminum Content)

The aluminum content of the surface layer containing aluminum oxide particles embedded therein (shot-blasted surface layer) shall be 4 at. % or above. If the mean aluminum content is below 4 at. %, the aluminum oxide content of the shot-blasted surface layer formed by the shot blasting process using aluminum oxide particles is insufficient, and the titanium material of pure titanium or a titanium alloy has insufficient high-temperature oxidation resistance. Further more, high-temperature oxidation resistance reduces.

There is no upper limit to the mean aluminum content. The higher the mean aluminum content, the higher will be an expected effect on improving high-temperature oxidation resistance. A substantial upper limit to the mean aluminum content is dependent on the ability of the shot blasting process and limits to processing conditions. The method mentioned in Patent document 6 processes the surface of the titanium alloy by a shot blasting process using hard particles of alumina or the like. This shot blasting process is intended to fill up voids in an Al-containing layer, such as a layer formed by hot-dip Al plating, and to cover unplated parts by the compressive action of the shot-blasting hard particles and is undoubtedly different from the present invention that implants alumina in the surface of titanium by shot blasting. The alumina used by the shot blasting process of Patent document 8 falls down after impinging on the Al-containing surface layer.

(Measurement of Mean Aluminum Content)

The mean aluminum concentration (content in atomic percent) of the shot-blasted surface layer can be measured through the quantitative analysis of the shot-blasted surface by wave dispersive spectroscopy (WDS) included in x-ray electron probe micro analysis (EPMA). More specifically, a test part of the surface layer to be analyzed is magnified at a magnification in the range of 500× to 1000× magnification, elements contained in the test part are determined qualitatively by qualitative analysis, and the element contents can be determined by quantifying the elements by semiquantitative analysis using a ZAF method. Although the element contents of the surface layer is dependent on the depth of penetration of an electron beam used for the analysis, the depth of penetration of the electron bean is in the range of about 1 to about 2.5 μm when acceleration voltage for the analysis is fixed at 15 kV. The mean aluminum content of the surface layer as mentioned in connection with the present invention is the mean aluminum content of a surface layer of a thickness in the range of about 1 to about 2.5 μm. In the following description, the mean aluminum content of the shot-blasted surface layer is based on this definition.

(Thickness of Shot-Blasted Surface Layer)

The shot-blasted surface layer is not a film or layer having a continuous thickness and is liable to be discontinuous films or layers having greatly different thicknesses. Therefore, the actual thicknesses of the shot-blasted surface layer are measured, the mean of the measured thicknesses is calculated for quantification or it is very difficult to determine a preferable thickness numerically. Even if the shot-blasted surface layer is films or layers having a continuous thickness, quantification is very difficult because the thicknesses are greatly different. It is preferable that the mean thickness of the shot-blasted surface layer determined by calculating the mean of measured thicknesses of optional parts of the surface of titanium determined through the observation of a section under an optical microscope at a magnification on the order of a 100× magnification is 1 μm or above regardless of the shot-blasted surface layer being a film or layer having either of a continuous thickness and a discontinuous thickness. If the shot-blasted surface layer is excessively thick, it is possible that the titanium material is deformed by excessively intense shot blasting. The mean thickness of the shot-blasted surface layer does not be above 20 μm.

(Shot Blasting Process)

A shot blasting process is selected to form a surface layer integrally including an aluminum oxide, as a principal component, a the titanium base by implanting aluminum oxide particles in the surface of a titanium material of pure titanium or a titanium alloy. The shot blasting process can implant an aluminum oxide in the base by spraying a high-speed stream of aluminum oxide particles on the surface of the titanium material. Thus a surface layer integrally containing aluminum oxide, as a principal component, and the titanium base can be formed.

The conventional evaporation process, the conventional PVD process and the conventional burning process cannot spray a high-speed stream of aluminum oxide particles on the surface of the titanium material and hence cannot implant the aluminum oxide particles in the surface of the titanium material. Consequently, although a surface layer of an aluminum oxide is formed on the titanium material, this surface layer contains titanium scarcely. Therefore, the surface layer is separated or divided from the titanium base with respect to composition. Thus a surface layer like the shot-blasted surface layer integrally including an aluminum oxide, as a principal component, and the titanium material of the present invention cannot be formed.

To form the surface layer integrally including an aluminum oxide, as a principal component, and the titanium material of the present invention, a suitable shot-blasting pressure for the shot blasting process is in the range of 3 to 7 atm. If the shot-blasting pressure is excessively low, the aluminum oxide cannot be satisfactorily implanted in the base. Consequently, a satisfactory surface layer cannot be formed and the surface layer cannot have an aluminum content of 4 at. % or above. If the shot-blasting pressure is excessively high, the titanium material (the base) is deformed and the thickness of the surface layer saturates even if the shot-blasting pressure is increased uselessly.

(Aluminum Oxide Particles)

The aluminum oxide particles used by the present invention for shot blasting may be an aggregate (powder) of particles including effective aluminum oxide. A concrete example of such an aggregate does not need necessarily to be an aggregate of 100% aluminum oxide particles, but the aggregate may contain oxide particles other than aluminum oxide particles or particles of a compound. Each of the aluminum oxide particles does not need to contain 100% aluminum oxide and may contain an oxide other than aluminum oxide or a compound.

It is preferable that the aggregate (powder) of aluminum oxide particles contain 80% by mass or above aluminum oxide ($Al_2O_3$) to form a shot-blasted surface layer having a mean aluminum content of 4 at. % or above. When the aggregate of aluminum oxide particles contain other oxide particles, the ratio of the amount of aluminum oxide particles each containing the aluminum oxide in a high content to the weight of the aggregate is increased such that the aggregate contains 80% by mass or above aluminum oxide.

It is preferable that each of the aluminum oxide particles used for the shot blasting process contains 80% by mass or above aluminum oxide ($Al_2O_3$); that is, it is preferable that each of the aluminum oxide particles contains other oxide or a compound in a content below 20% by mass. When each of the aluminum oxide particles contains 80% by mass or above aluminum oxide ($Al_2O_3$), the aggregate of particles can contain aluminum oxide in the foregoing desired ratio.

Oxides (impurities), other than aluminum oxide, liable to be contained in the aggregate are $Na_2O$, $TiO_2$, $Fe_2O_3$ and $SiO_2$. When the aggregate contains those oxides in either of oxide particles and components of each of particles, the aggregate should contain aluminum oxide in the foregoing aluminum oxide content.

Use of a mixture of aluminum oxide particles and other particles not containing aluminum oxide is included in the present invention when the contribution of aluminum oxide is a main part of high-temperature salt-damaged corrosion suppressing effect.

The shot blasting process may use commercially available aluminum oxide particles. However, it is preferable that the aluminum oxide particles contain 90% or above aluminum oxide particles of particle sizes in the range of about 180 to about 425 μm. If 90% or above of the aluminum oxide particles have particle sizes below the lower limit of the range of particle size or above the same, it is difficult to implant the aluminum oxide in the surface of titanium by shot blasting.

Generally, the aluminum oxide particles may be produced by any one of known processes including direct molten material pulverizing processes, such as an atomizing process, a molten material stirring process or a spin pulverizing process, or mechanical pulverizing processes, such as a stamp mill process, a ball mill process, a vibrating mill process and an Attoritor Union process.

(Titanium Material to be Applied)

Titanium materials as called by the present invention are materials of pure titanium or a titanium alloy formed in various shapes, such as a plate, a rod a wire and a pipe. The present invention does not place any restrictions on a titanium material to be processed by a surface treatment. Titanium alloys, such as α alloys, α-β alloys and β alloys, and pure titanium of types 1 to 4 specified in JIS may be used, corresponding to a required property (mechanical properties and so on). Possible titanium alloys are generally used titanium alloys including Ti-1.5Al, Ti-0.5Al-0.45Si-0.2Nb, Ti-6Al-4V, Ti-3Al-2.5V, Ti-15V-3Al-3Sn-3Cr and Ti-1Cu titanium alloys, and alloys obtained by changing the respective compositions of those titanium alloys.

(Titanium Material Excellent in High-Temperature Oxidation Resistance)

When a titanium material is intended specially for forming exhaust pipes, it is preferable that the titanium material as a base material (parent material) is the foregoing titanium alloy or pure titanium excellent in high-temperature oxidation resistance. Preferred ones of titanium materials excellent in high-temperature oxidation resistance will be described below.

(Si Content)

Addition of Si to a titanium alloy in a Si content in the range of 0.15 to 2% by mass improves the high-temperature oxidation resistance at a high temperature, such as 850° C. Preferably, a titanium alloy contains 0.15 to 2% by mass Si and Titanium and unavoidable impurities as other components.

Silicon (Si) has a high-temperature oxidation resistance improving effect and improves high-temperature strength. Therefore, the titanium alloy contains 0.15% by mass or above Si. A Si content higher than 2% by mass deteriorates formability remarkably and makes difficult forming the titanium alloy in an exhaust pipe.

(Nb, Mo and Cr)

Although Nb, Mo and Cr are less effective than Si, Nb, Mo and Cr are effective in improving high-temperature oxidation resistance. Synergistic effect of Nb, Mo and Cr contained in addition to Si (Nb, Mo and Cr coexisting with Si) and Si can be expected. Thus, the total of the Si content, and the Nb, the Mo and the Cr content of the titanium alloy may be 2% by mass. If the total of the Si content and those element contents is above 2% by mass, formability deteriorates and forming the titanium alloy in an exhaust pipe is difficult.

(Structure of Titanium Material)

The titanium material having excellent high-temperature oxidation resistance has the following preferable structure in addition to the foregoing composition. Preferably, one or some of the following measures including forming a surface layer having a high mean Si content in a Si-containing titanium alloy, forming a titanium material in structure having large mean grain size and forming a titanium material in acicular structure are taken selectively. Synergistic effect of those kinds of structure and the foregoing composition can be expected when those kinds of structure and the composition are used in combination. Addition of Al induces peeling of oxide scales in an atmosphere of a temperature not lower than 800° C. Therefore, the Al content should be, for example, below 0.30% by mass. When the foregoing measures including forming a surface layer having a high mean Si content in a Si-containing titanium alloy, forming a titanium material in structure having large mean grain size and forming a titanium material in acicular structure are taken in combination, the Al content can be positively increased to 0.30% by mass or above for the adjustment of mechanical properties at high temperatures.

(Si-Enrichment of Surface Layer)

The higher mean Si content of a surface layer of the Si-containing titanium alloy improves the high-temperature oxidation resistance of the titanium alloy more effectively. It is preferable that the surface layer of the titanium alloy has a mean Si content of 0.5 at. % or above. Silicon (Si) concentrated in the surface layer may be derived from the Si dissolved in the titanium or may exist in an intermetallic compound of Ti and Si, such as $Ti_5Si_3$, or a compound, such as Si oxide or silicon carbide.

Basically, the Si content of the surface layer increases with the increase of the Si content of the titanium alloy (the base). It is possible that the surface layer of a titanium alloy manufactured by a conventional method has a mean Si content of 0.5% by mass or above. On the other hand, when the titanium alloy is manufactured by some manufacturing method, it is possible that a surface layer of several micrometers in thickness contaminated with oxygen and carbon is formed in some cases. In such a case, the mean Si content of the surface layer is below 0.5 at. % and it is highly possible that an excellent high-temperature oxidation resistance improving effect cannot be expected. Thus the Si content of the surface layer of the titanium alloy is not dependent simply on the Si content of the titanium alloy. Therefore, it is preferable to determine manufacturing conditions selectively so that formation of a contaminated surface layer contaminated with oxygen and carbon may be avoided to form a surface layer having a mean Si content of 0.5 at. % or above.

A possible manufacturing condition capable of avoiding forming a contaminated surface layer can be a final process capable of removing a surface layer, such as a pickling process or a finish grinding process.

The Si content of the surface layer of the titanium alloy can be measured through the quantitative analysis of the surface by wave dispersive spectroscopy (WDS) included in x-ray electron probe micro analysis (EPMA). More specifically, a test part of the surface layer to be analyzed is magnified at a magnification in the range of 500× to 1000× magnification, elements contained in the test part are determined by qualitative analysis, the respective quantities of the elements are measured by semiquantitative analysis using a ZAF method and the element contents are determined. Although the element contents of the surface layer is dependent on the depth of penetration of an electron beam used for the analysis, the depth of penetration of the electron bean is in the range of about 1 to about 2.5 μm when acceleration voltage for the analysis is fixed at 15 kV. The Si content of the surface layer is the mean Si content of a surface layer of a thickness in the range of about 1 to about 2.5 μm. In the following description, the Si content of the surface layer is based on this definition.

(Equiaxed Grains)

A titanium alloy manufactured by a conventional method has an ordinary equiaxial structure. The equiaxial structure ensures the characteristics including formability and mechanical characteristics, such as strength, of the titanium alloy.

(Mean Grain Size)

The mean grain size of the titanium alloy dominates the high-temperature oxidation resistance of the titanium alloy having equiaxial structure. A comparatively large mean grain size enhances high-temperature oxidation resistance. More concretely, a high-temperature oxidation resistance enhancing effect becomes apparent when the mean grain size is 15 μm or above, and becomes remarkable when the mean grain size is, preferably 20 μm or above, more desirably, 30 μm or above. When the mean grain size is excessively large, surface roughening occurs during a forming process. When the titanium alloy is to be used for uses in which those conditions are important, the upper limit of the mean grain size is in the range of about 150 to about 200 μm, preferably, on the order of 100 μm.

Although the influence of the grain size on high-temperature oxidation resistance has not been elucidated up to the present, it is conjectured that the grain size is related with a mechanism of the progress of high-temperature oxidation. The diffusion of oxygen through the surface into a material when the material is exposed to high temperatures is likely to occur in grain boundaries. Thus it is conjectured that a material having a larger mean grain size and less grain boundaries can more effectively suppress high-temperature oxidation.

Although a cold rolling process, namely, a conventional process for manufacturing a titanium material, uses different percentage rolling reductions for rolling materials of different qualities, an ordinary percentage rolling reduction is in the range of about 20% to about 70%. An annealing temperature of an annealing process following the cold rolling process is in the range of 600° C. to 800° C. A vacuum annealing process using a long annealing time in the range of several hours to ten and odd hours uses a low annealing temperature in the range of about 600° C. and about 700° C. A continuous annealing and pickling process using a short processing time uses a high annealing temperature in the range of about 700° C. and about 800° C. It is difficult to make crystal grains grow in a mean grain size of 15 μm or above even if the titanium alloy is cold-rolled and annealed the alloying elements often obstruct the growth of crystal grains.

To manufacture a titanium alloy having crystal grains having a mean grain size of 15 μm or above, cold rolling process uses a low percentage rolling reduction of 20% or below and a high annealing temperature in the range of 825° C. to the β transformation point. Preferably, the percent rolling reduction is 15% or below, more desirably, 10% or below. A preferable annealing temperature is in the range of 850° C. to the β transformation point. When the annealing temperature is above the β transformation point, acicular structure is formed which will be described later. When it is important for a member to have equiaxed grains and to be industrially stable and satisfactory in formability and mechanical properties, an upper limit to the annealing temperature is the β transformation point or below.

(Effect of Al Content)

The Al content does not need to be below 0.30% by mass as mentioned above when a titanium alloy has equiaxial structure of comparatively coarse grains having a mean grain size of 15 μm or above. Equiaxial structure of comparatively coarse crystal grains suppresses the deterioration of high-temperature oxidation resistance caused by Al in proportion to the improvement of high-temperature oxidation resistance. This effect is higher when the mean grain size of the titanium alloy is greater.

(Method of Measuring Crystal Grain Size)

The term "crystal grain size" as used in the present invention signifies a mean grain size in a section along a rolling direction L in which a titanium material of a titanium alloy or pure titanium is rolled. A surface of a section of a specimen (test piece) sampled from a titanium material is ground roughly in a roughness between 0.05 and 0.1 mm, the ground surface is mirror-finished, and then the surface is etched. The etched surface is observed under an optical microscope at 100× magnification. Sizes of grains in the surface are measured in the rolling direction L by a line intercept method. The length of one measuring line is 0.95 mm. Five fields each of three lines are observed. Thus a total length of measuring line is 9.95×15 mm. A mean grain size of ten mean grain sizes of measured grain sizes of ten optional parts in a middle part of the plate excluding a leading end part and a trailing end part of the plate is employed as the mean grain size of the titanium material.

(Acicular Structure)

When uses allow some deterioration of formability and mechanical properties of the titanium material of a titanium alloy or pure titanium having equiaxed grains, the titanium material may have acicular structure created by heating the titanium material at the β transformation point or above for the further improvement of the high-temperature oxidation resistance.

Generally, titanium alloys have equiaxial structure because the titanium alloys are processed by a final annealing process at temperatures not higher than the β transformation point after cold rolling. According to the present invention, the titanium alloy may be formed in acicular structure instead of equiaxed grains to provide the titanium alloy with excellent high-temperature oxidation resistance. There is not any particular restriction on the method of forming the titanium alloy in acicular structure; the titanium alloy is formed in acicular structure by heating the titanium alloy at the β transformation point or above. The acicular structure can be created by heating a cold-rolled titanium material at the β transformation point or above and cooling the heated titanium material. For example, the structure of even coils, sheets and processed members of a titanium alloy of equiaxial structure obtained by heating the titanium alloy at a temperature not higher than the β transformation point after cold rolling can be converted into acicular structure by heating the coils, sheets and processed members again at temperatures not lower than the β transformation point.

When a titanium material is formed in acicular structure instead of equiaxial structure, the mean grain size of the titanium material cannot be determined while the mean grain size of equiaxial structure can be determined. Thus it is difficult to specify acicular structure by generally used mean grain size and aspect ratio. Acicular structure is specified precisely by a manufacturing process, namely, history. It is defined that this acicular structure is acicular structure created by a heat treatment process that heats pure titanium or a titanium alloy at a temperature not lower than the β transformation temperature. As mentioned above, the Al content does not need to be below 0.30% by mass when a titanium material has acicular structure. Acicular structure suppresses the deterioration of high-temperature oxidation resistance caused by Al in proportion to the improvement of high-temperature oxidation resistance.

Acicular structure, differing from equiaxial structure requiring the control of grain size, can be created necessarily (simply) by heating a titanium material at a temperature not lower than the β transformation point and cooling the heated titanium alloy regardless of the percentage rolling reduction of cold rolling (without controlling percentage rolling reduction). In some cases, restrictive conditions on the thickness of products for practical uses do not permit the optional selection and control of the percentage rolling reduction of cold rolling. In such a case, the selection of acicular structure without sticking to equiaxial structure is useful for improving high-temperature oxidation resistance. Cooling after heating may be natural cooling and neither of rapid cooling and force cooling is necessary.

As mentioned above, when a titanium material is formed in equiaxial structure of comparatively coarse grains having a mean grain size of 15 μm or above or in acicular structure by cold-rolling the titanium material, heating the cold-rolled titanium material at the β transformation point or above and cooling the heated titanium material, the Al content of the titanium material does not need to be below 0.30% by mass because the deterioration of high-temperature oxidation resistance caused by Al can be suppressed in proportion to the improvement of high-temperature oxidation resistance by equiaxial structure of comparatively coarse grains or acicular structure. Thus, when the titanium material has equiaxial structure of comparatively coarse grains or acicular structure, the sum of the Si and the Al content of the titanium material may be 2% by mass or below.

(Manufacturing Method)

Although a method of manufacturing the titanium material of the present invention is the foregoing preferred manufacturing method and is subject to conditions for selectively creating desired structure, the titanium material can be manufactured by an ordinary manufacturing method including an ingot forming process, a hot forging process, a hot rolling process, an annealing process, a cold rolling process, and an annealing process or a heat treatment process. Preferable structure for improving high-temperature oxidation resistance is selectively created, as mentioned above, by changing conditions for cold rolling, and annealing or heat treatment.

The present invention will be more concretely described in terms of its examples. It is noted that the following examples are not restrictive, proper changes may be made in the examples within a scope conforming to the foregoing and the following gist, and those changes are within the technical scope of the present invention.

Example 3

One of the surfaces of each of specimens of titanium materials shown in Tables 7 and 8 was processed by a shot blasting process using aluminum oxide powder of one of three types a to c shown in Table 6. The high-temperature oxidation resistance at high temperatures above 800° C. of the shot-blasted surfaces of the specimens was evaluated.

(Manufacture of Titanium Material)

Ingots having the compositions and a weight of about 120 g were made by using a button arc furnace. Each ingot was processed by conventional hot forging, hot rolling, annealing and cold rolling processes to obtain a cold-rolled sheet of 2 mm in thickness. The cold-rolled sheet was degreased and annealed at predetermined temperature under predetermined condition to adjust its structure. Specimens of 2 mm in thickness, 25 mm in width and 25 mm in length were sampled from the cold rolled sheets. In Table 8, the material of specimens 21 to 24 is commercial general-purpose titanium and the material of specimens 25 to 29 is a commercial general-purpose titanium alloy. Only the pure titanium of specimens 21 and 22 heated in a manner mentioned below to create acicular structure.

(Shot Blasting Process)

Conditions for a shot blasting process are shown in Tables 9 to 12. Blasting pressures shown in Tables 11 and 12 were used. The distance between a blast nozzle and the surface of each specimen was about 5 cm for all the specimens. The aluminum oxide powder was blown repeatedly against the surface of the specimen by a high-speed jet of air until the surface of the titanium material was uniformly shot-blasted. The duration of the shot blasting process was in the range of 2 to 5 s for each surface.

(Mean Grain Size Control)

The titanium materials whose specimens had mean grain sizes not greater than 10 μm (indicated by "<10" in Tables 6 and 7) among the titanium materials shown in Tables 7 and 8 were cold-rolled at a percentage rolling reduction of about 40% which is in a percentage rolling reduction range for conventional cold rolling and were processed by vacuum annealing at 800° C. for 6 min.

The titanium materials whose specimens had mean grain sizes above 15 μm were cold-rolled at low percentage rolling reductions selected from those in a range not higher than 20% and not in an ordinary range according to desired mean grain sizes and were processed by vacuum annealing at temperatures selected from those in a range of 825° C. to the β transformation point for 6 min. When a lower percentage rolling reduction for cold rolling in the specified range is selected, and a higher annealing temperature is used, crystal grains have a greater mean grain size.

(Acicular Structure)

Each of the specimens of acicular structure shown in Tables 7 and 8 were obtained by subjecting a plate obtained by cold rolling at a percentage rolling reduction of about 40% in an ordinary range to vacuum heating at 950° C. exceeding the β transformation point for 6 min. The structure of only the commercial general-purpose titanium of the specimens 21 and 22 was adjusted to acicular structure by this heating. The structure of a specimen sampled from this material was entirely acicular.

(Control of Mean Si Content of Surface Layer)

A test material having a Si-enriched surface layer having a mean Si content of 0.5 at. % or above shown in Table 7 was made. A material was subjected to cold rolling at a percentage rolling reduction of about 40%. The cold-rolled material was subjected to atmospheric annealing at 850° C. for 6 min instead of vacuum annealing. To remove a contaminated surface layer of several micrometers in thickness contaminated with oxygen, carbon and such from the titanium alloy, the titanium alloy was immersed in a molten salt heated at 600° C. and containing 55% by mass $NaNO_3$, 35% by mass NaOH and other substances including KCl and NaCl for 1 min, the titanium alloy was immersed in an aqueous solution heated at 60° C. and containing 1% by mass HF and 20% by mass $HNO_3$ for pickling to remove a layer of 50 μm in thickness from each side of the plate. The pickled plate was immersed in thoroughly stirred, flowing water for 2 min for cleaning immediately after pickling, and then the plate was immersed in stirred hot water heated at 80° C. for 3 min for hot-water cleaning to obtain a test material. The test material was cleaned by sufficient running-water immersion and hot-water cleaning to prevent the reduction of the Si content of the surface by the deposition of a thick oxide film and an impurity film of impurities contained in the pickling solution on the surface due to unsatisfactory cleaning after pickling. It is conjectured that the foregoing processes augment the Si content of the surface layer relatively.

The pickling process was carried out under the foregoing conditions after annealing to remove a surface layer of 200 μm in thickness (100 μm from each side) to remove completely contaminated surface layers (enriched layers) contaminated with oxygen, carbon and such due to the interaction of the surfaces with rolling mill oil during cold rolling. Since the test material was cleaned by sufficient running-water immersion and hot-water cleaning after pickling, it is conjectured that the foregoing processes augment the Si content of the surface layer relatively.

The mean grain size of specimens of test materials produced under the foregoing manufacturing conditions was 10 μm or below. A specimen having a mean grain size greater than 15 μm was made by cold rolling using a percentage rolling reduction of 20% or below. A still lower percentage rolling reduction was used to obtain a specimen having a still greater mean grain size. The Si-enrichment of a surface layer of a specimen having acicular structure was achieved by changing only conditions for annealing, and carrying out the atmospheric annealing at 950° C. higher than the β transformation point for 6 min and the foregoing processes for the Si enrichment of the surface layer under the foregoing conditions.

(Measurement of Mean Si Content of Surface Layer)

Each specimen was analyzed by the following method to determine the Si content (at. %) of the surface layer. The specimen was subjected to ultrasonic cleaning in acetone for several minutes to remove contaminants including oil adhering to the surface before analysis. The specimen was analyzed by an EPMA analyzer (JXA-8900RL, Nippon Denshi-sha). A magnification of 500× and an acceleration voltage of 15 kV were used for analysis. Elements present in the surface were identified by qualitative analysis, and the respective amounts of the elements present in the surface were determined by semi-quantitative analysis using a ZAF method.

(Measurement of Mean Aluminum Content of Shot-Blasted Layer)

The respective mean aluminum contents (Mean Al content (at. %) in tables) of shot-blasted layers shown in Tables 9 to 12 were measured by the foregoing method of analysis using the EPMA analyzer.

(Thickness of Shot-Blasted Layer)

The respective thicknesses of the shot-blasted layers of the specimens shown in Tables 9 to 12 determined through the observation of a section as mentioned above were in a preferable thickness range of 1 to 20 μm.

(High-Temperature Oxidation Resistance)

High-temperature oxidation resistance of the specimens shown in Tables 9 to 12 was evaluated by a high-temperature oxidation test. The weight of each of the specimens was measured before and after exposing the specimen to the high-temperature atmosphere of 850° C. higher than 800° C. for 100 h. An weight increment caused by the high-temperature oxidation test, namely, an oxidation weight increment (mg/cm$^2$), of the specimen was determined. It was decided that the specimens having a smaller oxidation weight increment were more excellent in high-temperature oxidation resistance at 850° C.

More concretely, the specimens having a weight increment of 5 mg/cm$^2$ or below were determined to be very excellent in high-temperature oxidation resistance and acceptable as a material for an exhaust muffler and were marked with ◎, and the specimens having a weight increment of 20 mg/cm$^2$ were determined to be fairly excellent in high-temperature oxidation resistance though not quite satisfactory and acceptable as a material for an exhaust muffler, and marked with ○. The specimens having a weight increment above 20 mg/cm$^2$ were determined to be unsatisfactory in high-temperature oxidation resistance for an exhaust muffler and marked with X.

All the specimens of the examples of the present invention shown in Tables 9, 10 and 11 had a shot-blasted layer formed by the shot blasting process using aluminum oxide particles and the shot-blasted layers had a mean aluminum content of 4 at. % or above and met the requisite conditions of the present invention. Conditions for shot blasting processes shown in Tables 9 to 12 were in preferable ranges of conditions.

Although the titanium parent materials (titanium base materials) of the specimens of those examples of the present invention were the same as those of all the specimens not having a shot-blasted layer of the comparative examples shown in Tables 9, 10 and 11, the specimens of the examples, as compared with the specimens of the comparative examples, were excellent in high-temperature oxidation resistance at 850° C.

It was found through the observation of the structure of the shot-blasted layer of each of the specimens of the examples of the present invention under an optical microscope at a 100× magnification that aluminum oxide particles were embedded in the titanium matrix.

(Effect of Composition and Structure)

Titanium materials 12, 13 and 19 of all the specimens of the examples of the present invention (all the specimens of the comparative examples) shown in Table 9 and all the specimens of the examples of the present invention (all the specimens of the comparative examples) shown in Table 10 were Si-containing titanium alloys containing Si or containing Si in combination with Nb, Mo and Cr, having equiaxial structure having a mean grain size of 15 μm or above, having a Si-enriched surface layer or having acicular structure instead of equiaxial structure.

Pure titanium materials 21 and 22 of the specimens of the examples of the present invention (specimens of the comparative examples) shown in Table 11 had acicular structure created by heating equiaxed grains as shown in Table 8.

Although the specimens of the comparative examples shown in Table 9 and all the specimens of the comparative examples shown in Table 10 of the titanium materials 12, 13 and 19, and the specimens of the comparative examples of the titanium materials 21 and 22 of shown in Table 11 processed by high-temperature oxidation resistance improving means did not have a surface layer formed by shot blasting using aluminum oxide particles, those specimens were excellent in high-temperature oxidation resistance at 850° C.

The specimens of the examples of the present invention formed by processing the titanium parent materials by shot blasting using aluminum oxide particles, as compared with the corresponding specimens of the comparative examples, were excellent in high-temperature oxidation resistance at 850° C.

The specimens of the comparative examples shown in Table 12 had a shot-blasted layer formed by shot blasting using aluminum oxide particles. However, those specimens were processed by a shot blasting process using the aluminum oxide powder of the type c having an aluminum oxide content below 80% by mass shown in table 6 or by a shot blasting process using a blasting pressure of 2 atm lower than 3 atm as shown in Table 12. Conditions of those shot blasting processes were not preferable ones.

Accordingly, the mean aluminum content of the shot-blasted layers of the specimens of the comparative examples using the titanium materials 21 and 22 was insufficient and below 4 at. %. Even though those specimens of the comparative examples of the parent materials of acicular structure and were excellent in high-temperature oxidation resistance at 850° C., the shot-blasted layer had no effect on the improvement of high-temperature oxidation resistance at 850° C.

The mean aluminum content of the shot-blasted layers of the specimens of the comparative examples of titanium materials 23 and 24 shown in Table 12 was insufficient and below 4 at. %. Since the parent materials of the specimens 23 and 24 of the comparative examples did not have a high-temperature oxidation resistance improving effect, the specimens 23 and 24 were unsatisfactory in high-temperature oxidation resistance at 850° C. and the shot-blasted layer had no effect on the improvement of high-temperature oxidation resistance at 850° C.

TABLE 6

| | Aluminum oxide particles for shot blasting | | |
|---|---|---|---|
| No. | Composition (% by mass) (Other elements: Unavoidable impurities) | $Al_2O_3$ content of particle aggregate (% by mass) | Particle sizes of 90% or above of oxide particles (μm) |
| a | $Al_2O_3$: 99.53%, $SiO_2$: 0.03%, $Fe_2O_3$: 0.02%, $Na_2O$: 0.3% | 99.5 | 180 to 425 |
| b | $Al_2O_3$: 85%, $SiO_2$: 9%, $Fe_2O_3$: 4%, $TiO_2$: 1% | 85.0 | 180 to 425 |
| c | $Al_2O_3$: 70%, $SiO_2$: 24%, $Fe_2O_3$: 4%, $TiO_2$: 1% | 70.0 | 180 to 425 |

* Particles sizes of other aluminum oxide particles (10%) are below 180 μm.

TABLE 7

| | | Shot-blasted titanium material No. 1: Titanium alloy | | | | | |
|---|---|---|---|---|---|---|---|
| | Type of | | | Composition | | Surface layer | |
| Specimen | titanium alloy | Composition (% by mass) | | | Mean grain size | Mean Si content | |
| No. | material | Basic composition | Selected elements | Structure | (μm) | (at. %) | Remarks |
| 1 | Si-containing | Ti—0.2Si—0.05Al | | Equiaxed | <10 | 0.4 | Si: Lower limit |
| 2 | equiaxed | Ti—1.0Si—0.05Al | | Equiaxed | <10 | 0.9 | |
| 3 | | Ti—2Si—0.05Al | | Equiaxed | <10 | 1.5 | Si: Upper limit |
| 4 | | Ti—0.5Si—0.05Al— | 0.2Nb | Equiaxed | <10 | 0.4 | |
| 5 | | Ti—0.5Si—0.05Al— | 0.2Nb—0.2Mo | Equiaxed | <10 | 0.4 | |
| 6 | | Ti—0.5Si—0.05Al— | 0.2Nb—0.2Mo—0.2Cr | Equiaxed | <10 | 0.4 | |
| 7 | | Ti—0.5Si—0.05Al— | 0.2Mo | Equiaxed | <10 | 0.4 | |
| 8 | | Ti—0.5Si—0.05Al— | 0.2Cr | Equiaxed | <10 | 0.4 | |
| 9 | | Ti—0.5Si—0.05Al | | Equiaxed | 50 | 0.4 | Coarse crystal grains |
| 10 | | Ti—1.0Si—0.05Al | | Equiaxed | <10 | 1.5 | Si concentration |
| 11 | | Ti—1.5Si—0.05Al | | Equiaxed | 54 | 2.1 | Si concentration |
| 12 | Acicular | Ti—1.0Si—0.05Al | | Acicular | — | 0.4 | |
| 13 | | Ti—1.0Si—0.1Al | | Acicular | — | 1.6 | Si concentration |
| 14 | | Ti—0.1Si—0.05Al | | Acicular | — | 0.4 | Excessively low Si content |
| 15 | | Ti—0.1Si—0.05Al— | 0.2Nb—0.2Mo—0.2Cr | Acicular | — | 0.4 | Excessively low Si content |
| 16 | Si-containing | Ti—0.1Si—0.05Al | 0.2Nb—0.2Mo—0.2Cr | Equiaxed | <10 | 0.4 | Excessively low Si content |
| 17 | equiaxed | Ti—0.1Si—0.05Al | | Equiaxed | 58 | 0.4 | Excessively low Si content |
| 18 | | Ti—0.1Si—0.05Al— | | Equiaxed | 57 | 0.4 | Excessively low Si content |
| 19 | | Ti—2.5Si—0.05Al | | Equiaxed | <10 | 0.4 | Excessively high Si content |
| 20 | | Ti—0.5Si—0.4Al | | Equiaxed | <10 | 0.4 | Excessively high Al content |

TABEL 8

| | | Shot-blasted titanium material No. 2 | | | |
|---|---|---|---|---|---|
| Specimen No. | Type of titanium material | Composition specified in JIS | Temperature of heating after cold rolling | Structure | Mean grain size (μm) |
| 21 | Pure titanium | Class 1 | β transformation point or above | Acicular | — |
| 22 | | Class 2 | β transformation point or above | Acicular | — |
| 23 | | Class 1 | Below β transformation point | Equiaxed | <10 |
| 24 | | Class 2 | Below β transformation point | Equiaxed | <10 |
| 25 | Titanium | Ti-1.5Al | Below β transformation point | Equiaxed | <10 |
| 26 | alloy | Ti—0.5Al—0.45Si—0.2Nb | Below β transformation point | Equiaxed | <10 |
| 27 | | Ti—6Al—4V | Below β transformation point | Equiaxed | <10 |
| 28 | | Ti—3Al—2.5V | Below β transformation point | Equiaxed | <10 |
| 29 | | Ti—15V—3Al—3Sn—3Cr | Below β transformation point | Equiaxed | <10 |

TABLE 9

| No. | Type of titanium material | Titanium materials shown in Tables 7 and 8 | Shot blasting process: Type of aluminum oxide (Table 6) | Shot blasting process: Blasting pressure (atm) | Shot blasting process: Mean Al content of processed layer (at. %) | Titanium material Oxidation increment ($mg/cm^2$) | Remarks |
|---|---|---|---|---|---|---|---|
| Examples | Si-containing equiaxed titanium alloy | 1 | a | 5 | 7.2 | ◎ | Si: Lower limit |
| | | 2 | a | 5 | 7.5 | ◎ | |
| | | 3 | a | 5 | 7.3 | ◎ | Si: Upper limit |
| | | 4 | a | 5 | 8.0 | ◎ | Containing Nb, Cr and Mo |
| | | 5 | a | 2 | 4.9 | ◎ | Containing Nb, Cr and Mo |
| | | 6 | b | 5 | 5.8 | ◎ | Containing Nb, Cr and Mo |
| | | 7 | b | 2 | 4.6 | ◎ | Containing Nb, Cr and Mo |
| | | 8 | b | 5 | 5.2 | ◎ | Containing Nb, Cr and Mo |
| | | 9 | a | 5 | 6.3 | ◎ | Coarse crystal grains |
| | | 10 | a | 5 | 6.7 | ◎ | Si concentration |
| | | 11 | b | 2 | 4.2 | ◎ | Si concentration |
| Comparative examples | Si-containing equiaxed titanium alloy | 1 | — | — | — | ○ | Si: Lower limit |
| | | 2 | — | — | — | ○ | |
| | | 3 | — | — | — | ○ | Si: Upper limit |
| | | 4 | — | — | — | ○ | Containing Nb, Cr and Mo |
| | | 5 | — | — | — | ○ | Containing Nb, Cr and Mo |
| | | 6 | — | — | — | ○ | Containing Nb, Cr and Mo |
| | | 7 | — | — | — | ○ | Containing Nb, Cr and Mo |
| | | 8 | — | — | — | ○ | Containing Nb, Cr and Mo |
| | | 9 | — | — | — | ○ | Coarse crystal grains |
| | | 10 | — | — | — | ○ | Si concentration |
| | | 11 | — | — | — | ○ | Si concentration |

TABLE 10

| No. | Type of titanium material | Titanium materials shown in Tables 7 and 8 | Shot blasting process: Type of aluminum oxide (Table 6) | Shot blasting process: Blasting pressure (atm) | Shot blasting process: Mean Al content of processed layer (at. %) | Titanium material Oxidation increment ($mg/cm^2$) | Remarks |
|---|---|---|---|---|---|---|---|
| Examples | Acicular | 12 | a | 5 | 7.2 | ◎ | |
| | | 13 | b | 5 | 5.3 | ◎ | Si concentration |
| | | 14 | a | 5 | 6.4 | ◎ | Excessively low Si content |
| | | 15 | b | 5 | 4.7 | ◎ | Excessively low Si content |
| Comparative examples | Acicular | 12 | — | — | — | ○ | |
| | | 13 | — | — | — | ○ | Si concentration |
| | | 14 | — | — | — | X | Excessively low Si content |
| | | 15 | — | — | — | X | Excessively low Si content |
| Examples | Si-containing equiaxed | 16 | a | 5 | 6.0 | ○ | Excessively low Si content |
| | | 17 | a | 5 | 6.9 | ○ | Excessively low Si content |
| | | 18 | a | 5 | 6.5 | ○ | Excessively low Si content |
| | | 19 | a | 5 | 7.2 | ◎ | Excessively high Si content |
| | | 20 | a | 5 | 8.5 | ○ | Excessively high Al content |
| Comparative examples | Si-containing equiaxed | 16 | — | — | — | X | Excessively low Si content |
| | | 17 | — | — | — | X | Excessively low Si content |
| | | 18 | — | — | — | X | Excessively low Si content |
| | | 19 | — | — | — | ○ | Excessively high Si content |
| | | 20 | — | — | — | X | Excessively high Al content |

TABLE 11

| No. | Type of titanium material | Titanium materials shown in Tables 7 and 8 | Shot blasting process: Type of aluminum oxide (Table 6) | Shot blasting process: Blasting pressure (atm) | Shot blasting process: Mean Al content of processed layer (at. %) | Titanium material Oxidation increment ($mg/cm^2$) | Remarks |
|---|---|---|---|---|---|---|---|
| Examples | Pure titanium | 21 | a | 5 | 7.3 | ◎ | Acicular |
| | | 22 | b | 5 | 5.7 | ◎ | Acicular |
| | | 23 | a | 5 | 7.4 | ○ | Equiaxed |
| | | 24 | b | 5 | 5.9 | ○ | Equiaxed |
| Comparative examples | Pure titanium | 21 | — | — | — | ○ | Acicular |
| | | 22 | — | — | — | ○ | Acicular |
| | | 23 | — | — | — | X | Equiaxed |
| | | 24 | — | — | — | X | Equiaxed |

TABLE 11-continued

| No. | Type of titanium material | Titanium materials shown in Tables 7 and 8 | Shot blasting process: Type of aluminum oxide (Table 6) | Blasting pressure (atm) | Mean Al content of processed layer (at. %) | Titanium material Oxidation increment ($mg/cm^2$) | Remarks |
|---|---|---|---|---|---|---|---|
| Examples | Titanium alloy | 25 | a | 5 | 7.3 | ○ | Equiaxed |
| | | 26 | a | 5 | 7.9 | ○ | Equiaxed |
| | | 27 | a | 5 | 8.3 | ○ | Equiaxed |
| | | 28 | a | 5 | 9.0 | ○ | Equiaxed |
| | | 29 | a | 5 | 7.3 | ○ | Equiaxed |
| Comparative examples | Titanium alloy | 25 | — | — | — | X | Equiaxed |
| | | 26 | — | — | — | X | Equiaxed |
| | | 27 | — | — | — | X | Equiaxed |
| | | 28 | — | — | — | X | Equiaxed |
| | | 29 | — | — | — | X | Equiaxed |

TABEL 12

| No. | Type of titanium material | Titanium materials shown in Tables 7 and 8 | Shot blasting process: Type of aluminum oxide (Table 6) | Blasting pressure (atm) | Mean Al content of processed layer (at. %) | Titanium material Oxidation increment ($mg/cm^2$) | Remarks |
|---|---|---|---|---|---|---|---|
| Comparative examples | Pure titanium | 21 | c | 5 | 3.5 | ○ | Acicular |
| | | 22 | c | 5 | 3.2 | ○ | Acicular |
| | | 23 | c | 5 | 3.3 | x | Equiaxed |
| | | 24 | c | 5 | 3.3 | x | Equiaxed |
| | | 21 | a | 2 | 2.3 | ○ | Acicular |
| | | 21 | b | 2 | 2.4 | ○ | Acicular |
| | | 23 | a | 2 | 2.0 | x | Equiaxed |
| | | 23 | b | 2 | 1.9 | x | Equiaxed |

INDUSTRIAL APPLICABILITY

The present invention provides titanium alloys and exhaust pipes having excellent high-temperature oxidation resistance at high temperatures exceeding 800° C., such as 850° C., for engines. Exhaust pipes made of the titanium alloys of the present invention for engines include those of various types of united construction, such as welded construction and mechanically joined construction. Although the titanium alloys of the present invention are particularly excellent in high-temperature oxidation resistance at high temperatures above 800° C., it goes without saying that the titanium alloys of the present invention are superior in oxidation resistance to the conventional materials and are useful for use in an environment of temperatures not higher than 800° C.

The invention claimed is:

1. A titanium alloy, consisting of an equiaxial structure having a mean grain size of 15 μm or above, wherein a composition of the titanium alloy consists of by mass:

Si in an amount of from 0.15 to 2%,

Al in an amount of below 0.30%, optionally one or more elements selected from the group consisting of Nb, Mo, and Cr as an additive, and titanium and unavoidable impurities.

2. The titanium alloy according to claim 1, wherein a composition of a surface layer of the titanium alloy has a mean Si content of 0.5 at. % or above.

3. A titanium alloy composition, comprising:

the titanium alloy according to claim 1, and an organometallic compound film coating a surface of the titanium alloy, wherein the film has a mean thickness between 10 and 100 μm in a dry state and an Al content between 30 and 90% by mass in a dry state.

4. An exhaust pipe, comprising the titanium alloy according to claim 1.

5. The titanium alloy according to claim 1, wherein an amount of Si in the composition is from 0.7% to 2% by mass.

6. The titanium alloy according to claim 1, wherein the titanium alloy is manufactured by a process comprising cold rolling a hot rolled titanium alloy.

7. The titanium alloy according to claim 1, wherein the titanium alloy is manufactured by a process comprising cold rolling a hot rolled titanium alloy, and wherein a percentage of cold rolling reduction is 20% or below.

8. A titanium alloy, consisting of an equiaxial structure having a mean grain size of 15 μm or above, wherein a composition of the titanium alloy consists of by mass, Si in an amount of from 0.15 to 2%, Al in an amount of below 0.30%, optionally one or more elements selected from the group consisting of Nb, Mo and Cr as an additive, and titanium and unavoidable impurities, and wherein a sum amount of Al and Si in the composition is 2% by mass or below.

9. The titanium alloy according to claim 8, wherein an amount of Si in the composition is from 0.7% to 2% by mass.

10. The titanium alloy according to claim 8, wherein the titanium alloy is manufactured by a process comprising cold rolling a hot rolled titanium alloy.

11. The titanium alloy according to claim 8, wherein the titanium alloy is manufactured by a process comprising cold rolling a hot rolled titanium alloy, and wherein a percentage of cold rolling reduction is 20% or below.

* * * * *